US007661434B2

(12) United States Patent
Frazier

(10) Patent No.: US 7,661,434 B2
(45) **Date of Patent: *Feb. 16, 2010**

(54) HAIR-ON-HAIR EXTENSION SYSTEM

(76) Inventor: Carol W. Frazier, 2114 Seward Ave., Evanston, IL (US) 60202-1948

( * ) Notice: Subject to any disclaimer, the term of this patent is extended or adjusted under 35 U.S.C. 154(b) by 579 days.

This patent is subject to a terminal disclaimer.

(21) Appl. No.: 11/414,354

(22) Filed: May 1, 2006

(65) Prior Publication Data

US 2006/0191550 A1 Aug. 31, 2006

Related U.S. Application Data

(63) Continuation-in-part of application No. 11/197,487, filed on Aug. 5, 2005, now Pat. No. 7,320,327, which is a continuation-in-part of application No. 11/016,714, filed on Dec. 21, 2004, now abandoned, which is a continuation of application No. 10/336,008, filed on Jan. 3, 2003, now Pat. No. 6,832,614.

(51) Int. Cl.
*A41G 3/00* (2006.01)
*A41G 5/00* (2006.01)

(52) U.S. Cl. ..... 132/201; 132/53

(58) Field of Classification Search ..... 132/53, 132/201, 54, 55, 56
See application file for complete search history.

(56) References Cited

U.S. PATENT DOCUMENTS 1,519,107 A * 12/1924 Breslauer ..... 132/53
2,621,663 A 12/1952 Jenkins
2,651,310 A * 9/1953 Selson ..... 132/274
2,865,380 A 12/1958 Mitchell
3,280,826 A 10/1966 Jenkins
3,295,534 A 1/1967 Dorkin
3,385,305 A * 5/1968 Buzzelli ..... 132/105
3,812,867 A 5/1974 Wanderman et al.
4,372,330 A 2/1983 Nelson
4,771,798 A 9/1988 Candino
4,830,029 A 5/1989 Bird
4,966,173 A 10/1990 Russell (Continued)

FOREIGN PATENT DOCUMENTS

DE 3722108 1/1989

(Continued)

*Primary Examiner*—Robyn Doan
(74) *Attorney, Agent, or Firm*—Richard C. Litman

(57) ABSTRACT

The hair-on-hair extension system has hair extensions that include a generally continuous span of natural and/or synthetic attachment hair strands extending from the weft base or edge of the attachment. The attachment hair strands are braided or intertwined directly into braids formed in the native hair of the wearer as those braids are being formed, without the need for additional attachment apparatus. The weft base may include a relatively narrow, linear weft edge having the hair extension and attachment strands extending in the opposite or same direction therefrom, or may include a two-dimensional crown sheet having the hair extension strands extending from a series of wefts from one surface of the sheet and the hair attachment strands extending from the opposite surface. The hair extension may include a separator sheet between the hair extension and hair attachment strands to facilitate manipulation of the hair attachment strands during installation.

11 Claims, 16 Drawing Sheets

U.S. PATENT DOCUMENTS

| | | | |
|---|---|---|---|
| 5,072,745 | A | 12/1991 | Cheh |
| 5,107,867 | A | 4/1992 | Barrington |
| 5,121,761 | A | 6/1992 | Meister |
| 5,357,986 | A | 10/1994 | Hargrett |
| 5,497,795 | A | 3/1996 | Hibbard |
| 5,551,452 | A | 9/1996 | Barlow |
| 5,575,298 | A | 11/1996 | Hinton |
| 5,586,566 | A | 12/1996 | Kim et al. |
| 5,634,478 | A | 6/1997 | Shakir |
| 5,655,550 | A | 8/1997 | Keating |
| 5,722,434 | A | 3/1998 | Walker |
| 5,727,574 | A | 3/1998 | Frye |
| 5,740,819 | A | 4/1998 | Hicks |
| 5,758,670 | A | 6/1998 | Ogunro |
| 6,009,882 | A | 1/2000 | Schine et al. |
| 6,019,107 | A | 2/2000 | Overmyer et al. |
| 6,135,122 | A | 10/2000 | Campbell et al. |
| 6,405,736 | B2 | 6/2002 | Townsend |
| 6,446,636 | B1 | 9/2002 | Vittallo |
| 6,581,609 | B2 * | 6/2003 | Ott ..... 132/201 |
| 6,832,614 | B2 * | 12/2004 | Frazier ..... 132/53 |
| 7,320,327 | B2 * | 1/2008 | Frazier ..... 132/201 |
| 2001/0035192 | A1 | 11/2001 | Townsend |
| 2001/0037813 | A1 | 11/2001 | Ra |
| 2005/0098191 | A1 | 5/2005 | Frazier |
| 2005/0161057 | A1 | 7/2005 | Takemura |
| 2005/0194015 | A1 | 9/2005 | Watts |
| 2005/0268929 | A1 | 12/2005 | Frazier |
| 2006/0000484 | A1 | 1/2006 | Romanchik |
| 2006/0027244 | A1 | 2/2006 | Nomura |

FOREIGN PATENT DOCUMENTS

| | | |
|---|---|---|
| EP | 876773 | 11/1998 |
| GB | 2327605 | 2/1999 |
| JP | 08-052017 | 2/1996 |
| JP | 2005-206997 | 8/2005 |
| WO | WO 87/05783 | 10/1987 |

* cited by examiner

HAIR-ON-HAIR EXTENSION SYSTEM

CROSS REFERENCE TO RELATED PATENT APPLICATIONS

This application is a continuation-in-part of U.S. patent application Ser. No. 11/197,487 filed on Aug. 5, 2005, now U.S. Pat. No. 7,320,327, which is a continuation in part of U.S. patent application Ser. No. 11/016,714 filed on Dec. 21, 2004, now abandoned, which is a continuation in part of U.S. patent application Ser. No. 10/336,008 filed on Jan. 3, 2003, which issued Dec. 21, 2004 as U.S. Pat. No. 6,832,614, which is hereby incorporated by reference in its entirety.

BACKGROUND OF THE INVENTION

1. Field of the Invention

The present invention relates generally to devices and methods for adding supplemental hair to the natural or native hair of a wearer, and more specifically to various embodiments of a wefted hair extension, each extension having a generally continuous row, ply, layer, or span of natural and/or synthetic attachment hair strands or fine filaments extending therefrom. The attachment hair strands or filaments of the wefted extensions are braided integrally into the wearer's hair and concealed therein to secure the extension to the natural hair of the wearer.

2. Description of the Related Art

Hair weaving, which is the process of adding human or artificial hair to the native hair of a person, is a technique that has been known for a very long time. Wigs and toupees of human or artificial hair have been manufactured and used for centuries for various reasons, e.g., to enhance the appearance of the wearer, to cover flaws or imperfections in the natural or native hair of the wearer, to indicate profession, rank, or social status, etc. Most such additions to the natural hair of the wearer result in an artificial appearance, or at least are unsatisfactory in some manner. More recently, the application of relatively smaller hairpieces and extensions has been developed. Such smaller hair extensions are often more satisfactory for the wearer, as they can be more permanently attached to the scalp or native hair of the wearer, and in some cases can be treated and cared for in the same manner as the natural or native hair of the person wearing the hair extension.

A number of different types of hair extensions and application or attachment techniques have been developed over the years, but the basic types of hair extensions may be broadly divided into two categories, i.e., loose hair strands which are not attached to one another, and wefted hair extensions in which the hair extension strands are bound or wefted together along a common line or edge, with the hair extending from the weft or binding. These two different types of hair extensions may be further divided by their method of attachment to the native hair of the wearer. A large number of different attachment or application principles or techniques have been developed over the years, ranging from mechanical attachment (clamps, clips, etc.) to adhesives (chemical or heat setting, etc.) to braiding, weaving, sewing, tying, and/or knotting the hair extension into the hair of the wearer.

Each of the above types of hair extensions and methods of attachment to the head or hair of the wearer has various disadvantages. In the case of loose, unwefted hair, the attachment process is extremely tedious and time consuming, and is thus relatively costly to perform. The result can be a beautiful and natural appearing hairdo if the hairdresser is talented, with the supplemental hair extension capable of being treated as natural hair and remaining in place for weeks.

The manufacture of bound or wefted hair was developed to facilitate the application of hair extensions to the head of the wearer, with the bound hair greatly shortening the time required for such an operation or application. However, the various means of attaching such wefts to the hair or scalp of the wearer all leave something to be desired. In the case of adhesives, the chemicals and/or heat applied to bond the adhesive can be injurious to the scalp and/or native hair of the wearer. Mechanical attachments, e.g., small clips and clamps, etc., tend to interfere with hair care, as they can loosen during combing, brushing, or normal hair care procedures and fall from the hair unexpectedly. Where wefted hair extensions are sewn onto the native hair braids of the wearer, the process is time consuming and requires support in removal of the hair extension at a later date, because the natural hair can be easily cut along with the binding threads when the hair extension is removed.

A discussion of the related art of which the present inventor is aware, and its differences and distinctions from the present invention, is provided below.

U.S. Pat. No. 2,621,663, issued on Dec. 16, 1952 to Christina M. Jenkins, titled "Permanently Attaching Commercial Hair To Live Hair," describes a method of attaching loose, unwefted hair to the native hair of the wearer, using a series of strands or fibers which are interwoven with the native and supplemental hair. One end of each strand is attached to a support stand, with the opposite ends of the strands being woven into the wearer's hair. The Jenkins method is not used with wefted hair, nor is there any disclosure of any provision of single or multiple laminations of hair wefts with essentially continuous plies of attachment hair strands extending therefrom, as in the case of the present invention. The Jenkins method is extremely time consuming and tedious, as a relatively small number of supplemental hairs must be interwoven with the three strands of native hair, with the operation being repeated innumerable times to complete the operation. Moreover, the Jenkins method requires the wearer to use a professional to remove the supplemental hair, as the attachment strands must be cut, and the wearer cannot safely cut the attachment strands him or herself without the near certainty that at least some of the native hair will also be cut. There is no such risk using the present hair wefts and methods of attachment, as the braided attachment need only be unraveled to release the hair wefts therefrom.

U.S. Pat. No. 2,865,380, issued on Dec. 23, 1958 to Princess Mitchell, titled "Hairpieces And Method Of Hair Preparation," describes a two step process wherein a series of French plaits (French braids) are formed transversely about the sides, back, and upper portion of the wearer's scalp, to lie closely adjacent to the scalp in the manner of cornrow type braids. After the braids or plaits are formed, a corresponding series of wefted hair extensions are sewn thereto. This process can take up to twice as long as the present method (attaching hair wefts to native hair by braiding the weft attachment hair strands into the braids simultaneously with braid formation), as the Mitchell method requires that the braids or plaits be completed first, and then that the extensions be sewn in place along the braids in a separate, subsequent operation. Moreover, the Mitchell method can be troublesome to reverse by the wearer, due to the difficulty in cutting the attachment threads without cutting the native hair of the wearer. The Mitchell method is essentially that described as "weaving with braid track" in the His Or Her Hair website, noted further below.

U.S. Pat. No. 3,280,826, issued on Oct. 25, 1966 to Christina M. Jenkins, titled "Hair Piece And Method Of Making And Permanently Attaching Same," describes the use of garter-type clips for the attachment of hair wefts to the native hair of the wearer. While such clips are easily installed and removed, their bulk and mass make hair care (particularly combing and brushing) difficult, to say the least. The present system does not present such problems, as the scalp surface braid attachment leaves the rest of the hair free along its entire length.

U.S. Pat. No. 3,295,534, issued on Jan. 3, 1967 to Jess Dorkin, titled "Hair Thickening Method," describes the use of a urethane adhesive for the attachment of individual or multiple strands of hair to the scalp or native hair of the wearer. This type of supplemental hair attachment is also relatively time consuming, due to the strand by strand (or relatively few strands) securing at each step. The removal process is not appreciably quicker, due to the need to carefully remove all of the adhesive, either by chemical or other means. The chemicals can be harsh on the scalp and hair of the wearer, and daily grooming, as well as the installation and removal processes, can damage the native or natural hair of the wearer.

U.S. Pat. No. 4,372,330, issued on Feb. 8, 1983 to Charles W. Nelson, titled "Method And Apparatus For Attachment Of Hair Units," describes the use of filaments of fine wire or the like, which are twisted about a relatively small number of grouped strands of native hair of the wearer, and secured using an adhesive. The strands are sewn in place using a needle, and continue from strand group to strand group to form a continuous chain. The result provides a base for the attachment of supplemental hair thereto, but Nelson does not disclose any actual supplemental hair configuration or structure in his patent. The Nelson system suffers from the same problems as noted above when supplemental hair extensions are sewn to braids or plaits, in that the hair extensions must be removed by a professional in order to minimize damage to the native hair of the wearer, and moreover, the Nelson system consumes an inordinate amount of time for both installation and removal, as the tedious twisting and gluing of the filament to the native hair of the wearer must be accomplished before the hair extensions may be attached thereto, and removed after removal of the extensions.

U.S. Pat. No. 4,830,029, issued on May 16, 1989 to Raymond F. Bird, titled "Method Of And Apparatus For Styling Hair," describes a manufactured hair weft having a pocket formed in the weft or bound edge or "tape." A wire loop is installed in the pocket, and is used to attach the hair extension to the native hair of the wearer. While the Bird method does not require the braiding or plaiting of the wearer's native hair, the specialized wire loop and pocketed weft tape are relatively bulky and massive, and result in some discomfort for the wearer when attempting to rest or sleep. The use of a wire clip or loop to secure the hair extension to the native hair also creates some difficulty in hair care during brushing, combing, etc.

U.S. Pat. No. 4,966,173, issued on Oct. 30, 1990 to Della L. Russell, titled "Hairpiece For Compensation Of Hair Loss," describes a headband having supplemental hair disposed thereon. The Russell headband is easily installed and removed by the wearer, but is intended only to cover a relatively small patch. The Russell band cannot support a relatively large and full hair extension, with its relatively large mass, as can the present system with its positive attachment to the native hair of the wearer.

U.S. Pat. No. 5,072,745, issued on Dec. 17, 1991 to Byung J. Cheh, titled "Hair Extension Process," describes the use of hot melted adhesive to bond small groups of strands of supplemental hair extensions to the native hair of the wearer. Cheh does not disclose the use of any form of wefted hair extension with his process. The Cheh process, and the problems associated therewith, are more closely related to the process described in the Dorkin '534 U.S. patent, described further above, than they are to the present invention.

U.S. Pat. No. 5,107,867, issued on Apr. 28, 1992 to Mark C. Barrington, titled "Process For Extending Human Hair," describes the installation of a small plug to the ends of a relatively small number of strands of supplemental hair. A heat shrink sleeve is installed near the base of a relatively small number of strands of the wearer's native hair, and the plug of the supplemental hair group is placed in the heat shrink sleeve. The heat shrink sleeve is then shrunk to grip the supplemental hair plug therein. This technique results in the same problems as incurred with methods wherein the supplemental hair is glued or mechanically fastened to small tufts of the wearer's native hair, i.e., the difficulty in combing or brushing out the hair when a large number of relatively small nodules are installed therein. Also, while Barrington states that the supplemental hair plugs may be removed by reheating them, this is a job for a professional. Such a task could not be readily accomplished by the wearer of the Barrington hair supplements, by herself.

U.S. Pat. No. 5,121,761, issued on Jun. 16, 1992 to Karen L. Meister, titled "Method For Attaching Hair Extensions," describes the use of a series of small sleeves that are crimped about relatively small clumps or tufts of native hair, near the bases thereof. A wefted hair extension is then sewn through the bases of the tufts, using a needle and thread. The Meister method eliminates the need to braid the native hair of the wearer, but substitutes a series of small crimped sleeves that must be removed professionally when the wearer wishes to remove the hair extensions. The Meister system, with the exception of its use of a wefted hair extension, more closely resembles the supplemental hair attachment method disclosed in the Barrington '867 U.S. patent, discussed immediately above, than it does the present supplemental hair attachment method.

U.S. Pat. No. 5,357,986, issued on Oct. 25, 1994 to Drucilla W. Hargrett, titled "Hair Locking Process And Apparatus," describes a braid assembly, which is secured to tufts of the native hair of the wearer, rather than braiding the native hair itself. The braid attachment includes a series of small rings therein, with the weft of supplemental hair also having a like series of rings. The weft and braid rings are sewn together to secure the supplemental hair weft to the braid attachment of the wearer. This process involves a fair amount of time, as the braid material must be braided into the hair of the wearer, before the wefted hair extension can be sewn to the rings of the braid. This ring-to-ring attachment is relatively loose in comparison to the present wefted hair extension attachment, and moreover cannot be removed by the wearer, due to the need to determine the location of the attachment thread precisely in order to cut it without damaging the native hair of the wearer.

U.S. Pat. No. 5,551,452, issued on Sep. 3, 1996 to Eslie O. Barlow, titled "Hairpiece With Adjustable Support Loop," describes a loop having a series of hair tufts extending therefrom. The loop has an adjustable circumference, but is still placed relatively loosely upon the head. No means for positively attaching the loop or supplemental hair to the natural hair of the wearer is disclosed.

U.S. Pat. No. 5,575,298, issued on Nov. 19, 1996 to Cassandra Hinton, titled "Apparatus And Method For Concealing Attachments Of Hair Supplements," describes a relatively short and narrow adhesive tape for concealing the braid line of a conventional hair weave attachment braid, e.g., the weave attachment braid as disclosed in the Mitchell '380 U.S. patent discussed further above. The Hinton tape includes a covering of relatively short hairs on the outer surface thereof, to camouflage the underlying braid and weft attachment. The hair weft extension disclosed in the Hinton U.S. patent is conventional, i.e., it does not include any attachment strands, as provided by the hair weft extensions of the present invention.

U.S. Pat. No. 5,740,819, issued on Apr. 21, 1998 to Janice A. Hicks, titled "Process For Securing Supplemental Hair To The Natural Hair Of An Individual," describes a relatively complex process in which a wefted hair extension is bound by sewing a series of blanket stitches therein adjacent to one end thereof, with the bound portion of the weft then being sewn into a previously formed braid in the wearer's native hair. The Hicks method is quite complex in comparison to the present method, and requires considerably more time to complete. Moreover, Hicks requires professional care in the removal of hair extensions attached using her method, due to the need to carefully sever the strands of thread securing the hair extension wefts to the braids without damaging the native hair of the wearer. This is not a problem with the present hair weft extensions and method.

U.S. Pat. No. 6,019,107, issued on Feb. 1, 2000 to Tatiana L. Overmyer et al., titled "Detachable Hairpiece," describes a barrette type device having a hair extension permanently attached thereto and extending therefrom. The barrette clips to the native hair of the wearer, with the hair extension extending from the barrette to provide the appearance of longer hair for the wearer. No wefted hair extension having attachment strands extending from the wefted ends for attachment directly to the native hair of the wearer is provided by Overmyer et al. Moreover, the Overmyer et al. barrette extension cannot be worn for extended periods of time, as can the present wefted hair extensions.

U.S. Pat. No. 6,135,122, issued on Oct. 24, 2000 to Annie L. Campbell et al., titled "Self Adhesive Hair Weft Extension And Method Of Attaching Same," describes a wefted hair extension having a contact adhesive strip applied to the wefted or bound end of the hair extension. A release strip is removed from the adhesive, and the hair extension is adhesively attached to the native hair of the wearer for use. The adhesive principle also results in damage to the hair when the tape is removed, with at least some hair being torn, broken, and/or pulled out by the roots. Campbell et al. do not disclose a hair weft extension having a continuous ply of attachment strands or filaments extending therefrom for intertwining into the native hair of the wearer as that hair is French braided, as is done by means of the present hair extension attachment.

U.S. Pat. No. 6,405,736, issued on Jun. 18, 2002 to Valerie Townsend, titled "Method Of Using A Self Adhesive Hair Extension," describes a hair extension and process which are very closely related to the disclosure of the Campbell et al. '122 U.S. patent discussed immediately above. Townsend differs from Campbell et al. in that Townsend sews a strip of adhesive material to the wefted end of the hair extension, and adhesively attaches her hair extension to the scalp of the wearer, rather than to the hair, as is the case with Campbell et al. Townsend does not disclose any attachment strands extending from the wefted end of the hair extension for intertwining into braids as they are formed.

U.S. Pat. No. 6,446,636, issued on Sep. 10, 2002 to Christine M. Vittallo, titled "Method Of Attaching Supplemental Hair To Human Natural Hair," describes the application of a liquid adhesive directly to the scalp or native hair of the wearer, and then adhesively securing a weft of supplemental hair to the adhesive area. This method is more closely related to the adhesive attachment methods of the Campbell et al. '122 and Townsend '736 U.S. patents, than it is to the present invention with its continuous ply or span attachment hair strands or filaments extending from the weft portion of the hair extension for intertwining with a braid formed of the wearer's native hair.

U.S. Patent Publication No. 2001/035,192, published on Nov. 1, 2001 to Valerie Townsend, titled "Self Adhesive Hair Extension," describes a wefted hair extension and method of attachment which closely resemble those described in the '736 issued U.S. patent to the same inventor, described further above. No non-adhesive attachment means using strands of material extending from the hair weft, is disclosed by Townsend.

U.S. Patent Publication No. 2001/037,813, published on Nov. 8, 2001 to James W. Ra, titled "Attachable Hair Extension," describes the use of an adhesive strip disposed across the individual strands of a mass of hair to form a wefted hair extension. Some of the adhesive is exposed between the individual hair strands. A release sheet is removed from the adhesive, and the weft is applied to the hair or scalp of the wearer, with the exposed adhesive between the hair strands serving to secure the weft to the hair or scalp of the wearer. This hair extension and method are more closely related to the various adhesively applied hair extensions of the Campbell et al. '122 and Townsend '736 U.S. patents and the Townsend '192 U.S. Patent Publication, than it is to the present hair extension attachment invention with its intertwining of the weft attachment strands with the braiding of the wearer's native hair.

International Patent No. WO 87/5783, published on Oct. 8, 1987 to Raymond F. Bird, titled "A Method Of And Apparatus For Styling Hair," describes the same invention as that described in the '029 U.S. patent to the same inventor, discussed further above. The points raised in that discussion are seen to apply here, as well.

German Patent No. 3,722,108, published on Jan. 12, 1989 to Jun Plenk, titled "Device For Attaching Artificial Hair To Natural Hair," describes (according to the drawings and English abstract) a small cylindrical sleeve or clamp which is secured to the native hair of the wearer, with a weft of hair having a cooperating mechanical attachment device extending therefrom. The assembly is somewhat related to that disclosed in the Barrington '867 U.S. patent, discussed further above, in which a small heat shrink sleeve is secured about a tuft of the native hair of the wearer, and a plug forming the end of a hair extension. While the '108 German Patent Publication discloses the mechanical attachment of a complete weft of hair, no disclosure is made of provision for a continuous span of attachment hair strands from the weft, for interweaving with the native hair.

Japanese Patent Publication No. 8-052,017, published on Feb. 27, 1996 to Hideo Shigekuni, titled "Hair Braiding-In Method," describes (according to the drawings and English abstract) a method of forming an elongate braid extending from the head, with a pair of decorative cords woven or braided with the hair braid elements. There is no disclosure of the formation of one or more braids along the scalp with the simultaneous braiding of weft attachment strands therewith, as provided by the present weft embodiments and methods of attachment.

European Patent No. 876,773, published on Nov. 11, 1998 to Angelo Lo Giudice, titled "Method, Apparatus And Hair Extension Product Thereof," describes a method of forming hair weft extensions from loose locks of hair by applying a thermoplastic resin to the ends of the hair strands to seal them together. The '773 Patent Publication is primarily directed to a tool for forming the hair wefts in the desired shape, and sealing or adhesively attaching the common ends together.

No means is disclosed for attaching the completed wefted hair extensions to the native hair of the wearer, as described in the present disclosure.

British Patent No. 2,327,605, published on Feb. 3, 1999 to Taiwo Arogundade, titled "Scalp Patch For Hair Extension," describes a patch having hair extending from one surface for securing to the central area of the scalp of a wearer. The edge of the patch is devoid of hair, and provides a margin for sewing the patch to cornrow braids formed in the native hair of the wearer. The Arogundade '605 Patent Publication further discloses the use of a plurality of parallel cornrow braids formed in the native hair of the wearer, and stitching one or more lengths of wefted hair extensions together in a sinusoidal configuration for greater fullness. However, no disclosure is made by Arogundade of any provision for attachment strands extending from the weft or bound edge of a hair extension, for interweaving or intertwining into braids formed in the native hair of the wearer, as provided by the present invention.

Japanese Patent Publication No. 2005-206,997, published on Aug. 4, 2005 to Hideji Yasui, titled "Method For Weaving Hair Extension Into Braid," describes (according to the drawings and English abstract) a method of braiding an extension strand (not a weft) into the native hair of the wearer. The completed braid basically forms a four-element braid initially to anchor the doubled end of the elongate extension, with a three-element braid extending therefrom. No means of forming one or more braids along the scalp with the simultaneous braiding of weft attachment strands therewith is apparent in the '997 Japanese Patent Publication, as provided by the present weft embodiments and methods of attachment.

In addition to the above patents and patent publications, the present inventor is aware of certain web sites which also describe wefted hair extensions and their attachment to the head or hair of the wearer. The sites www.hisandher.com and www.glamourhair.com are sites for commercial outlets which sell loose and wefted hair extensions and materials for their installation in and removal from the native hair of the wearer. Each of the above sites describes various types of wefted hair extensions and methods for braiding, adhesively bonding, weaving, or mechanically attaching such wefted hair extensions to the native hair of the wearer. However, neither of the above web sites disclose any wefted hair extensions having attachment strands extending therefrom, nor any means of intertwining such attachment strands with the native hair of the wearer as it is braided.

None of the above inventions and patents, taken either singly or in combination, is seen to describe the instant invention as claimed. Thus, a hair-on-hair extension system solving the aforementioned problems is desired.

SUMMARY OF THE INVENTION

The hair-on-hair extension system comprises various embodiments of wefted hair extensions, with each of the extension embodiments including a generally continuous row, ply, layer, or span of natural and/or synthetic attachment hair strands or filaments extending from the wefted or bound edge thereof. Methods of attaching the present wefted hair extensions include intertwining the attachment hair strands integrally with the native hair of the wearer as it is braided. (The term "native hair" is used generally throughout the present disclosure to describe the hair of the wearer, which is rooted naturally in and growing from the scalp of the wearer of the hair extensions. The term "native hair" is used in order to differentiate from natural hair, as the hair extensions themselves and their attachment strands or filaments are commonly, and preferably, formed of natural human hair, although not from the native hair of the wearer.)

A first embodiment of the present hair extension comprises a wefted hair extension including a generally continuous span or ply of natural and/or synthetic hair attachment strands or filaments extending from the weft edge, opposite the direction of the hair extending therefrom. This hair extension may comprise a single wefted row, or in a second embodiment may be sewn or otherwise combined with similar extensions to provide multiple rows of overlapping wefts, to create a fuller and more dense hair extension. The ply of attachment filaments is preferably sewn to the outside of the last of the weft rows where multiple wefts are secured together, but may be sewn between rows, if so desired.

A second embodiment of the hair extension comprises a wefted hair extension including a generally continuous span or ply of natural and/or synthetic hair attachment strands or filaments extending from the weft edge in the same direction as the hair extending therefrom. This hair extension may comprise a single wefted row, or in another embodiment may be sewn or otherwise combined with similar extensions to provide multiple rows of overlapping wefts to create a fuller and more dense hair extension. The row, ply, layer, or span of attachment hair strands or filaments is preferably sewn outside the last row where multiple wefts are secured together, but may be sewn between the weft rows. A water insoluble separator sheet may be placed between the hair extension and the attachment hair strands or filaments to facilitate the manipulation of the attachment hair strands during installation of the hair extension. The separator sheet is sewn into the hair attachment seam at the weft and is easily pulled loose after the hair weft is installed.

Other embodiments of the hair extension attachment include one or more linear weft bases stitched or otherwise attached (e.g., adhesive) to a two-dimensional base sheet. The hair weft(s) is/are secured to one side or surface of the thin, flexible base sheet, with the continuous span of attachment hair strands being attached to the opposite side or surface of the base sheet. A separator sheet may be provided about the periphery of the base sheet, if so desired.

Various methods of securing and removing the wefted hair extensions to and from the native hair of the wearer include the common steps of providing a wefted hair extension having a continuous row, ply, layer, sheet, etc. of attachment hair strands extending therefrom, and intertwining or braiding the attachment hair strands integrally into a braid as the braid is formed in the native hair of the wearer. The above-described method or process is considerably quicker and more efficient than other braided attachment processes known to the present inventor, as the braiding of the native hair of the wearer and the attachment of the wefted extensions by means of their attachment hair strands or filaments is accomplished in a single step. The hair extensions are easily removed by the wearer, merely by unbraiding the braids. No delicate cutting of threads, removal of adhesives or numerous small fasteners, or other operations requiring the assistance of a professional are required for the removal of the hair extensions.

Accordingly, it is a principal object of the invention to provide a wefted hair extension having several embodiments, each of which includes a generally continuous row, ply, layer, or span of natural and/or synthetic attachment hair strands or filaments extending therefrom for intertwining integrally into a braid of native hair of the wearer of the hair extension.

It is another object of the invention to provide such wefted hair extensions in a base-piece configuration having the attachment hair strands extending from the weft edge in the opposite direction from the hair extension strands.

It is an additional object of the invention to provide such wefted hair extensions in a finishing-piece configuration having the attachment hair strands extending from the weft edge in the same direction as the hair extension strands and with a separator sheet disposed between the hair extension strands and the hair attachment strands.

It is a further object of the invention to provide such hair weft extensions comprising a single wefted row or edge, and also comprising multiple, overlapping weft rows or edges, in order to provide fuller and denser hair in the extension.

Yet another object of the invention is to provide a hair weft extension having a two-dimensional base, i.e., a longitudinal and lateral span, including hair wefts attached to one side thereof and a continuous span or ply of hair attachment strands or filaments extending from the opposite side thereof.

Still another object of the invention is to provide methods of installing and removing the above-described wefted hair extensions into and from the native hair of the wearer.

It is an object of the invention to provide improved elements and arrangements thereof for the purposes described which is inexpensive, dependable and fully effective in accomplishing its intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of a wefted hair-on-hair extension and methods of attaching and removing the hair extensions to and from the native hair of a wearer of a hair extension. Each of the hair extension embodiments includes a generally continuous, unbroken ply, row, sheet, layer, or span of attachment hair strands or filaments for braiding directly into the native hair of the wearer at the time the braids are formed. The attachment hair strands may be formed of natural hair, synthetic hair, or a mixture of the two, as desired. This eliminates the two-step process required for hair weaving, wherein a braid(s) must be formed, and then the hair extension(s) is/are attached to the braid(s) in a subsequent operation. Moreover, removal of the hair extensions may be accomplished by the wearer by merely unbraiding the braided hair to allow the attachment hair strands or filaments of the hair extensions to separate from the native hair of the wearer's head as the extension is unbraided. No tedious cutting of attachment threads, removal of adhesives, etc., is required with the hair-on-hair extensions.

Figure 1:
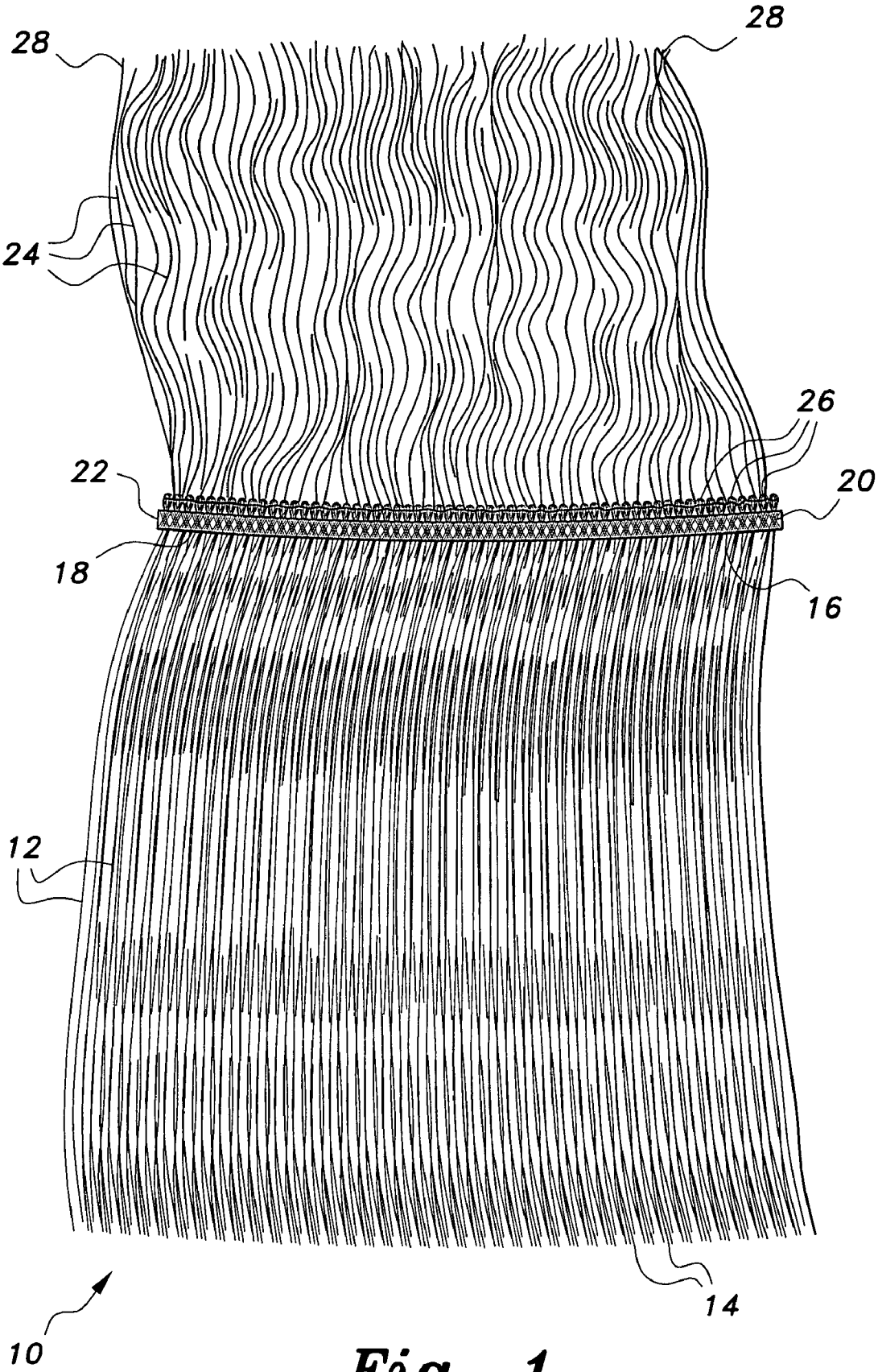
FIG. 1 is a rear elevation view of a first embodiment of a base piece hair extension attachment according to the present invention, with a continuous ply of attachment hair strands or fine filaments extending from a single weft edge in the opposite direction from the hair extension strands for installation along a hairline or part line of the wearer.

FIG. 1 of the drawings illustrates a short section of a first embodiment of the present hair extensions, designated as a base piece hair extension 10. The hair extension 10 includes a large number of individual hair strands 12 having free ends 14 and opposite weft attachment ends 16. The weft attachment ends are bound together in a single, continuous weft edge 18, which spans the extension 10 from a first end 20 to an opposite second end 22. The hair strands 12 extend essentially unidirectionally from the bound weft edge 18, and generally form a somewhat planar sheath of hair.

While the extension 10 of FIG. 1 is illustrated as a relatively short and narrow section, it should be noted that the extension 10 and other hair extensions disclosed herein would typically include hair strands having significantly greater length, e.g., eight or more inches, and wefts having substantially greater spans, e.g., thirty six to eighty four inches or more. Both the weft span and hair length of such extensive hair extensions may be cut or trimmed as desired. The relatively small and short extension 10 illustrated in FIG. 1 of the drawings, as well as other extensions disclosed herein, are shown as relatively short and narrow sections for clarity in the drawing Figs. The hair strands 12 used in the construction of the present hair extensions are preferably natural human hair. Such hair may be straight, as shown, or may be curled, kinky, or have any other pattern or form as desired. Such natural hair may retain its natural color, or may be dyed or otherwise treated as desired. Alternatively, the hair strands 12 may be formed of synthetic fibers, if so desired.

Rather than being sewn into braids formed in the wearer's hair, as is conventional in hair weaving, the present hair extension 10 and other hair extensions of the present invention include a generally continuous row, ply, layer, or span of natural and/or synthetic attachment hair strands or fine filaments or fibers 24 extending therefrom. The attachment hairs or filaments 24 have attachment ends 26 sewn or otherwise permanently and securely attached to the weft edge 18 of the extension 10, and opposite free ends 28. The attachment filaments 24 may be formed of any suitable flexible hair or hair-like material, so long as the filament material is compatible with braiding integrally into the native hair of the wearer. Preferably, natural hair is used, but other fine filaments, synthetic hair, etc. may be used to form the attachment strands of any of the hair extension embodiments of the present invention. In the hair extension embodiment 10 of FIG. 1, the attachment hair filaments 24 extend from the weft 18 generally coplanar with the plane of the hair strands 12, but in a direction opposite that of the hair strands 12, i.e., to the other side of the weft 18 from the hair strands 12. The strands or filaments 24 extend in a substantially continuous row, ply, layer, or span from the weft 18, with no substantial breaks or spaces between attachment points. The extension 10 may be considered as a "base piece," configured for attachment to the wearer's native hair at any suitable area thereof.

Figure 2:
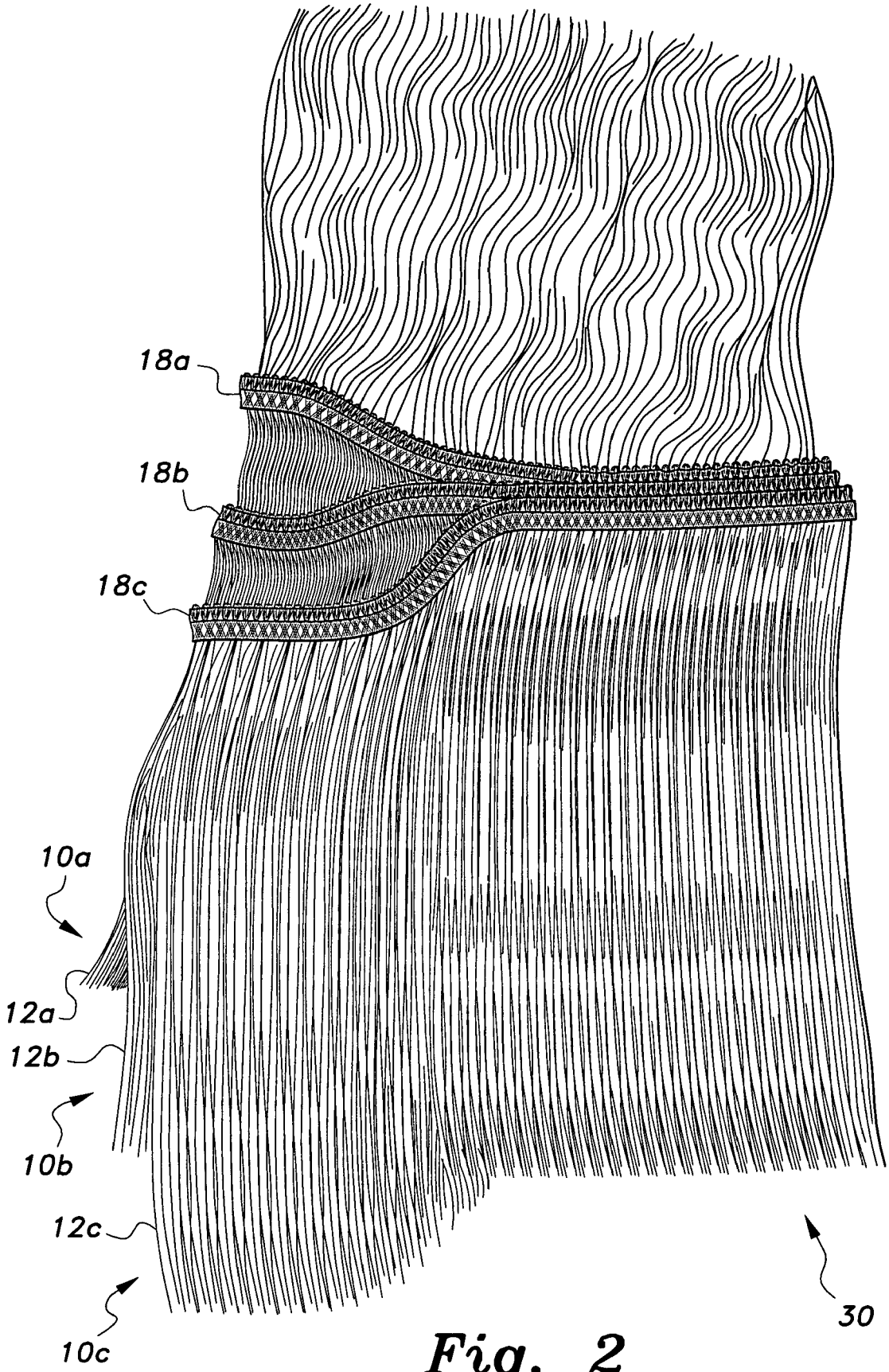
FIG. 2 is a rear elevation view of a partially constructed alternative embodiment of the wefted hair extension of FIG. 1, illustrating the overlapping assembly of a plurality of hair wefts to form a fuller and denser hair extension.

FIG. 2 illustrates an alternative embodiment of the wefted hair extension 10 of FIG. 1, in which a plurality of such extensions are sewn or otherwise permanently secured together along their wefted edges to form a multiple weft extension 30 having a fuller and denser fall or extension of hair. In FIG. 2, a series of wefted extensions 10*a*, 10*b*, and 10*c*, each substantially identical to the extension 10 of FIG. 1, are assembled together to form the multiple weft extension 30, by sewing or stitching their respective wefts 18*a*, 18*b*, and 18*c* together along their entire lengths. (The multiple weft extension 30 illustrated in FIG. 2 is incomplete, with the final stitching of the wefts 18*a*, 18*b*, and 18*c* shown uncompleted at the second ends thereof, in order to show clearly the three distinct wefts employed in the manufacture of the multiple weft extension 30.) The wefts 18*a*, 18*b*, and 18*c* are secured together in an overlapping configuration, with the upper edge of the weft 18*b* secured slightly below the upper edge of the weft 18*a*, and the upper edge of the weft 18*c* secured slightly below the upper edge of the weft 18*b*. The weft attachment ends 26 of the continuous ply or span of attachment hairs or filaments 24 are preferably secured outside the last row, but may be sewn between the first and second wefts 18*a* and 18*b*, i.e., those wefts which are disposed closest to the scalp of the wearer when the multiple weft extension 30 is installed on the head of a wearer, and extend in a direction opposite the hair strands 12*a*, 12*b*, and 12*c*, similarly to the configuration of the single weft extension 10 of FIG. 1.

Figure 3:
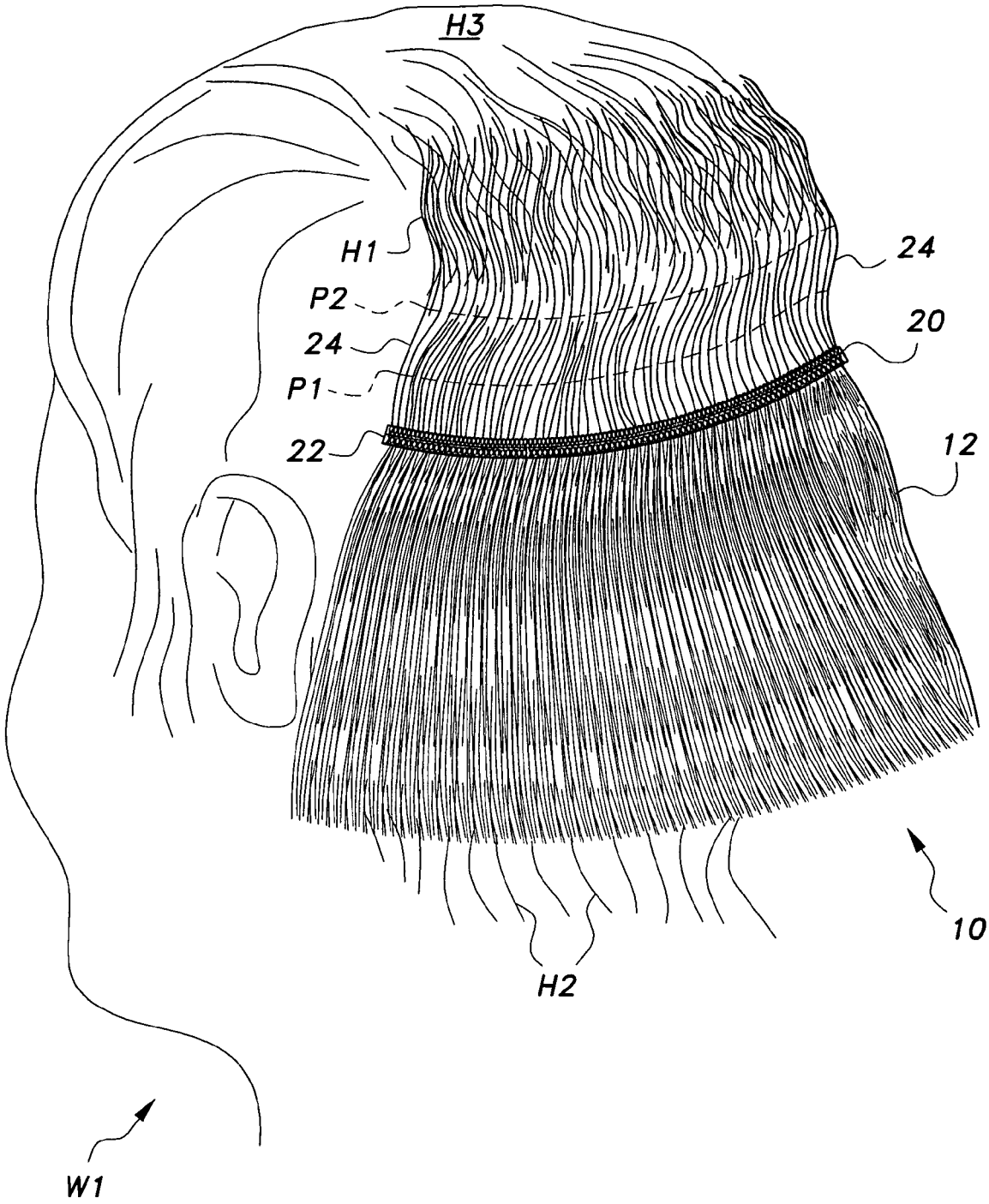
FIG. 3 is a rear perspective view of the head of a wearer of the present hair extension invention, showing a first step in the installation of a base piece hair extension to the native hair of the wearer.

FIGS. 3 through 7 illustrate the basic procedure in the installation of the single weft extension 10 of FIG. 1, to the native hair of a wearer of the device. In FIG. 3, first and second parts P1 and P2 have been formed transversely across the back of the head of a wearer W1 of the present hair extension 10, defining a transverse line or row of braidable native hair H1 between a lower area of native hair H2 and a higher area of native hair H3 of the wearer W1. The part lines P1 and P2 are shown in broken lines in FIG. 3, as they are essentially concealed in front of the continuous span or ply of weft attachment hair filaments 24. Again, it should be noted that typically the hair strands 12 of the hair extension 10 will be considerably longer than shown in FIG. 3. They are shown relatively short in the drawing Figs., for clarity in the drawings. Similarly, the width of the hair extension could be considerably greater as well, for folding back and forth through the wearer's hair for installing multiple rows of a single hair extension.

Figure 4:
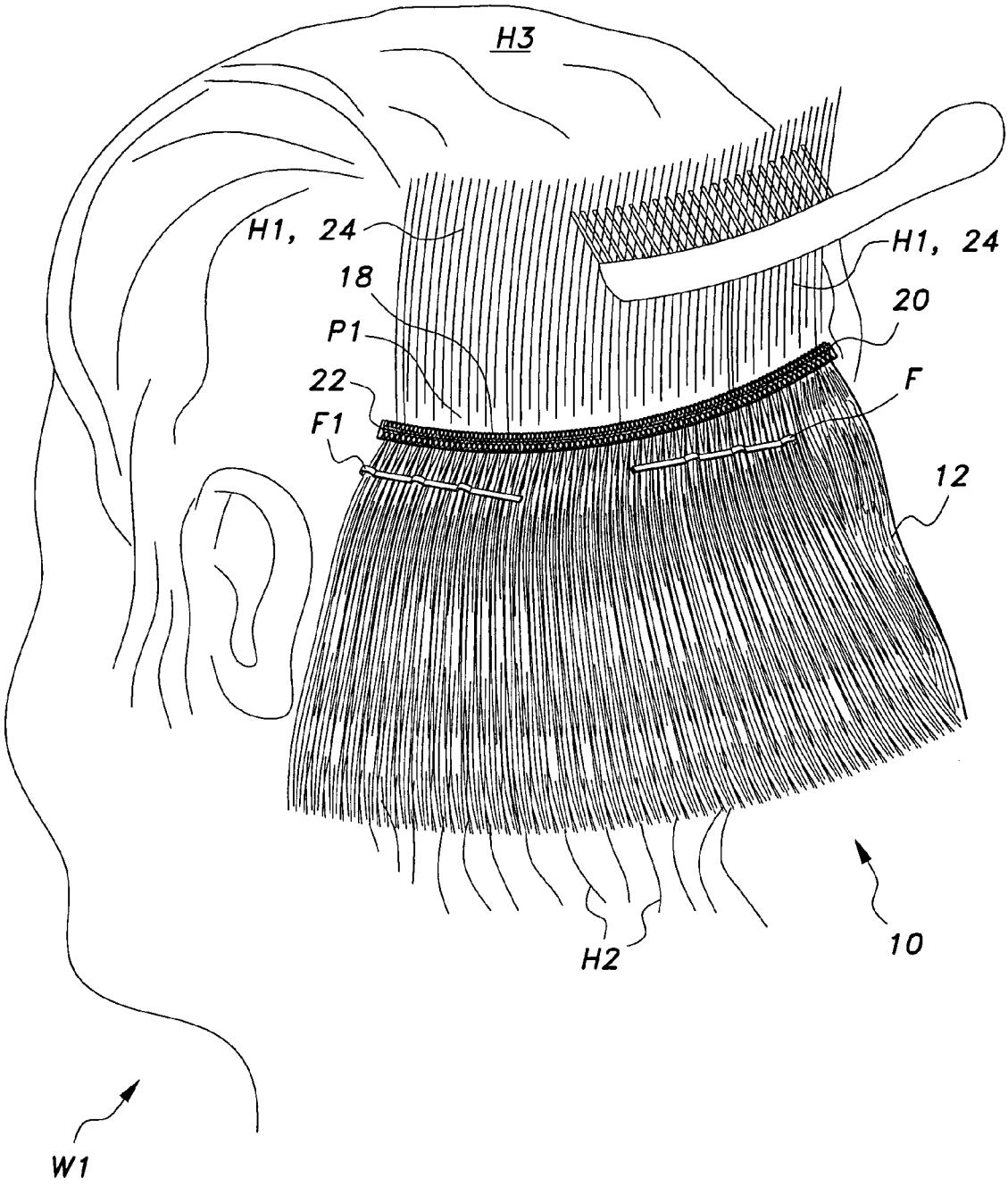
FIG. 4 is a rear perspective view of the wearer's head of FIG. 3, showing the second step in the installation of the base piece hair extension of the present invention.

The wefted hair extension 10 is placed along the first part line P1, immediately adjacent the row of the wearer's native hair H1 to be braided, preferably before forming the second part line P2. The first end 20 of the weft 18 is placed at the beginning of the first part line P1, and the extension 10 is secured in its proper position covering the lower hair area H2 of the wearer, using bobby pins or other suitable temporary fasteners F, generally as shown in FIG. 4 of the drawings. The continuous span of attachment hairs or filaments 24 is arranged to extend upwardly, across or over the braidable hair row H1, generally as shown in FIG. 3. The attachment hair filaments 24 are then combed into the native hair H1 between the two part lines P1 and P2 and combined therewith, generally as shown in FIG. 4 of the drawings.

Figure 5:
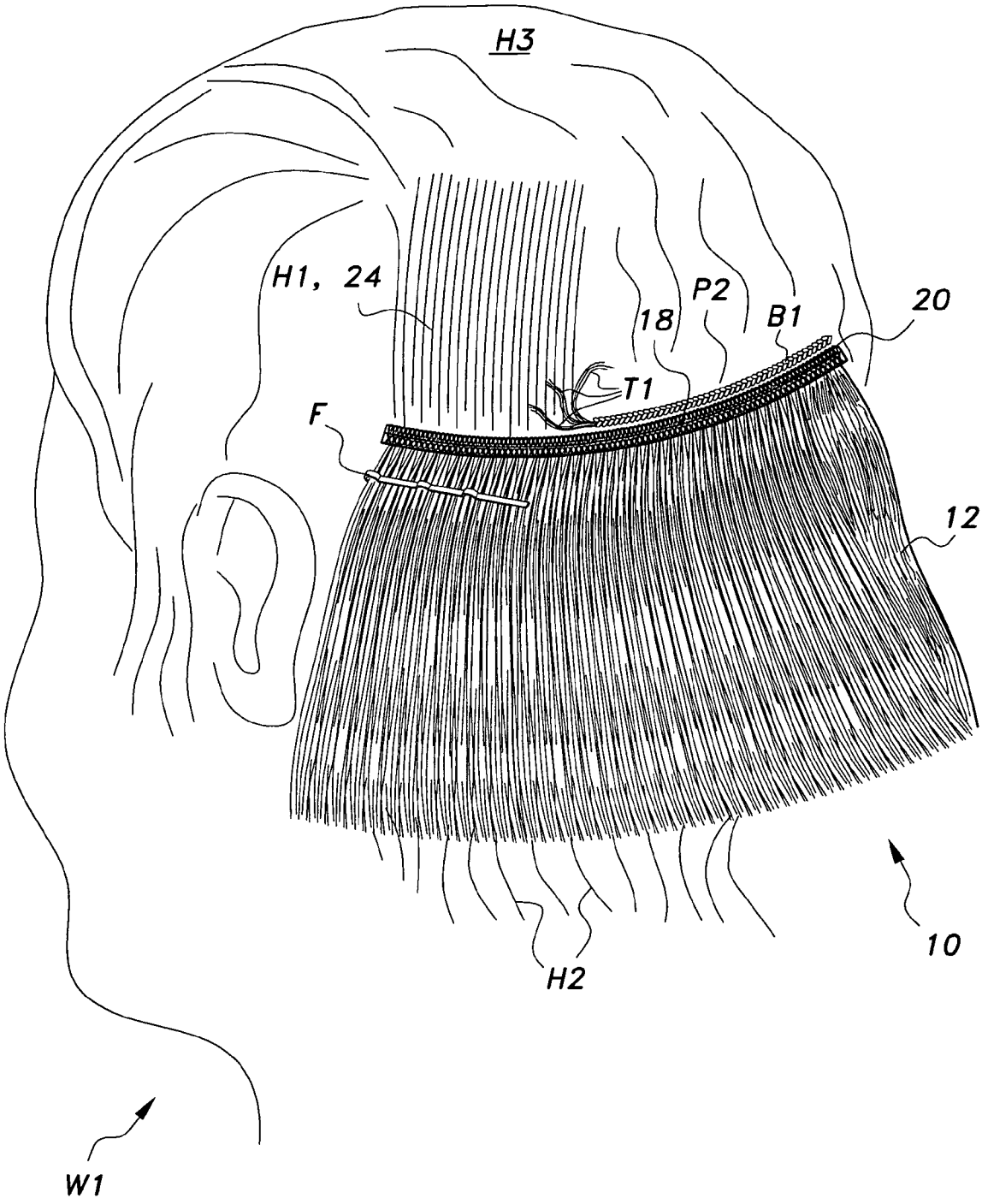
FIG. 5 is a rear perspective view of the wearer's head of FIGS. 3 and 4, showing the third step in the installation of the base piece hair extension of the present invention.

At this point, a braiding pattern is initiated in the row of hair H1 and attachment hair filaments 24 between the two part lines P1 and P2, generally as shown in FIG. 5 of the drawings. The wefted hair extension attachment filaments 24, which have been entrained in the braidable hair H1 during the combing step illustrated in FIG. 4, are braided integrally with the hair H1 during this step in the process. In FIG. 5, the braiding process has been started from the first end 20 of the hair extension 10, working from right to left across the back of the head of the wearer W1 to form the beginning of a first braid row B1. It should be noted that the initiation of the braiding sequence from the right side is not required, and that any braiding pattern may be used as desired, depending upon the orientation of the part lines P1, P2, etc. which may be formed in the hair of the wearer. The braiding is accomplished by dividing the strands of the native hair H1 and weft attachment hair filaments 24 combined therewith between the two part lines P1 and P2 into three sections to form multiple fingers T1 of the wearer's native hair, and then braiding these fingers T1 of native hair H1 and weft attachment hair filaments 24 together. A French braid may be formed, as shown, or some other type of braid may be formed as desired. The braiding is formed to lie immediately adjacent the scalp of the wearer, as is customary in the hair weaving art. The type or style of braid formed is similar to that known as "cornrow" braiding, in which a number of fine braids are formed in parallel rows to lie immediately adjacent the scalp of the wearer.

The above described method of attaching the present wefted hair extensions to the native hair of a wearer may be terminated at the completion of a single braided row, if so desired, generally as shown in FIG. 5 with its abbreviated weft span. If additional hair extensions are desired, separate lengths may be added by repeating the process illustrated in FIGS. 3 through 5 and described in detail above. However, it is anticipated that the wefted hair extension would normally be provided with a weft span considerably greater than that illustrated in FIGS. 1 through 5 of the drawings. Such wider weft spans would permit a single wefted extension to be folded back and forth over itself in multiple rows, and secured to the native hair of the wearer in a corresponding number of braid rows.

Figure 6:
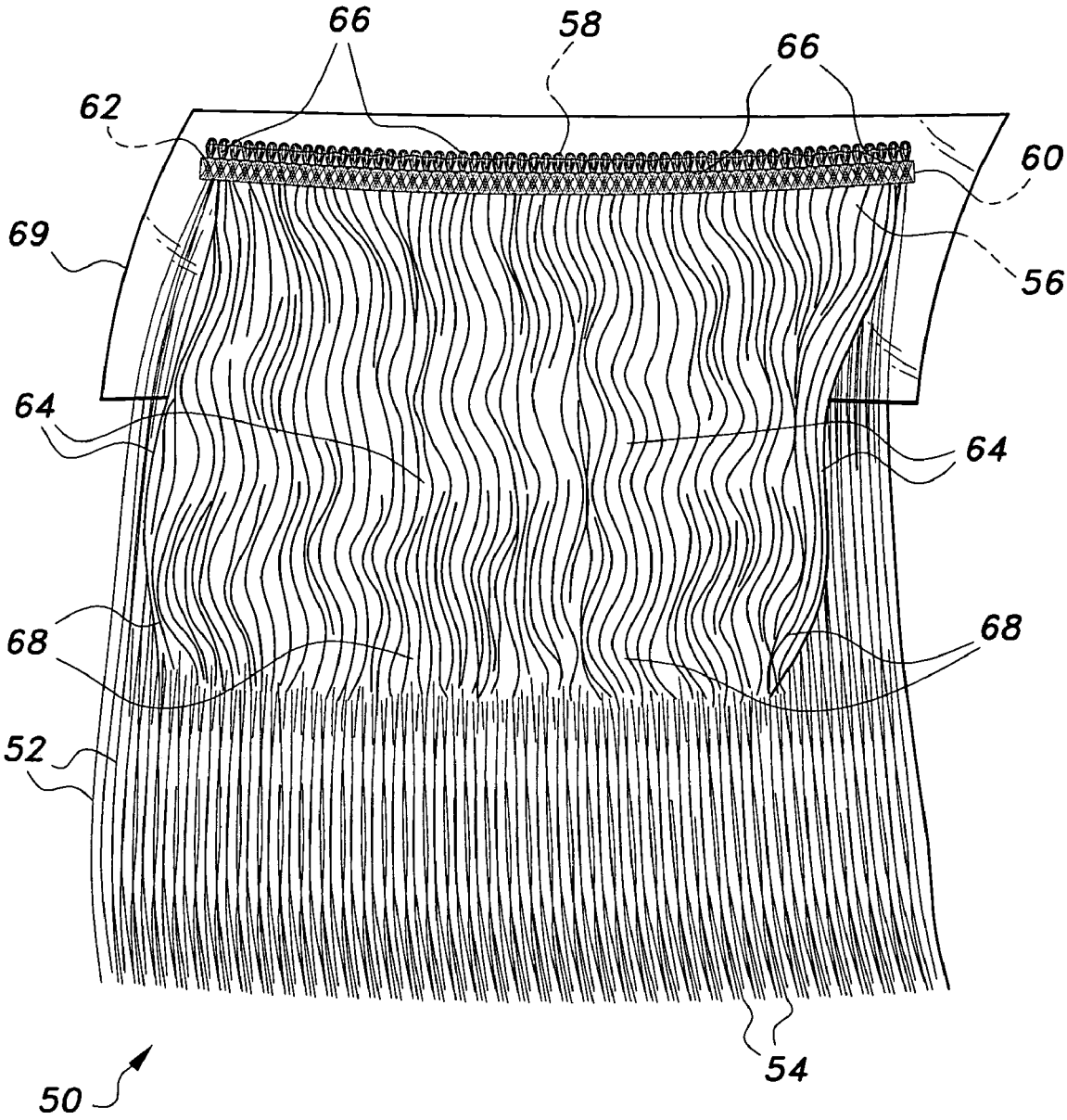
FIG. 6 is a rear elevation view of an embodiment of a finishing piece hair extension attachment according to the present invention, with a continuous ply of attachment hair strands extending from a single weft edge in the same direction as the hair extension strands for installation along a hairline or part line of the wearer and including a separator sheet between the hair extension strands and attachment hair strands.

The hair extensions may include a finishing hair extension piece, a first embodiment of which is illustrated in FIG. 6 and designated as wefted hair extension finishing piece 50. The finishing extension piece 50 of FIG. 6 includes a large number of individual extension hair strands 52 having free ends 54 and opposite weft attachment ends 56. These extension hair strands 52 form the visible or extended hair addition which will be visible to others who see the hair of the person wearing the extension piece 50 (or other embodiments). The weft attachment ends 56 of the hair extension strands or filaments 52 are bound together in a single, continuous weft base or edge 58, which spans the extension 50 from a first end 60 to an opposite second end 62. The weft base or edge 58 forms a narrow, thin, generally one-dimensional linear span due to the relatively fine hair strands 52 and stitching or sewing used to bind the hair strands 52 together along their weft attachment ends 56 to form the weft base or edge 58. Alternatively, the weft attachment ends 56 of the extension hair strands 52 may be bound together by an adhesive, or an adhesive may be used in addition to stitching the attachment ends 56 of the hair extension strands 52 together to form the weft base or edge 58. The hair extension strands 52 extend essentially unidirectionally from the bound weft base or edge 58, and generally form a somewhat planar sheath of hair.

While the extension 50 of FIG. 6 is illustrated as a relatively short and narrow section, it should be noted that the extension 50 and other hair extensions disclosed herein would typically include hair strands having significantly greater length, e.g., eight or more inches, and wefts having substantially greater spans, e.g., thirty-six to eighty-four inches or more. Both the weft span and hair length of such extensive hair extensions may be cut or trimmed as desired. The relatively small and short extension 50 illustrated in FIG. 6 of the drawings, as well as other extensions disclosed herein, are shown as relatively short and narrow sections for clarity in the drawings. The extension hair strands 52 used in the construction of the hair extensions are preferably natural human hair. Such hair may be straight, as shown, or may be curled, kinky, or have any other pattern or form as desired. Such natural hair may retain its natural color, or may be dyed or otherwise treated as desired. Alternatively, the extension hair strands 52 may be formed of synthetic fibers, if so desired, or a mix of natural hair and synthetic fibers may be used.

Rather than being sewn into braids formed in the wearer's hair, as is conventional in hair weaving, the hair extension 50 and other hair extensions of the present invention include a generally continuous row, ply, span, layer, or sheet of attachment hair or hair-like strands or filaments 64 extending therefrom. The attachment hair strands 64 have attachment ends 66 sewn or otherwise permanently and securely attached (e.g., by adhesive) to the weft base or edge 58 of the extension 50 opposite free ends 68. The attachment hair strands or filaments 64 may be formed of either natural or synthetic hair fibers or filaments, or a combination of both, so long as the strand material is compatible with braiding integrally into the native hair of the wearer. These attachment hair strands or filaments 64 may be of essentially identical material, color, and configuration to the display or extension hair strands 52, i.e., formed of natural or synthetic hair, but are attached as a separate ply to the weft binding or edge 58 in order to serve as the attachment means for the hair weft extension 50. These attachment hair strands 64 are not visible to a person viewing the hair of the wearer of the present extension 50 when the extension is installed upon the wearer's head, as the attachment hair strands 64 are bound or intertwined with the native hair of the wearer to secure the hair weft extension 50 to the native hair of the wearer, as described further below.

The attachment ends 66 of the attachment hair strands 64 extend in the same direction from the weft edge 58 as the extension hair strands 52, with the main lengths and free ends 68 of the attachment hair strands 64 lying in the same general plane as the extension hair strands 52 when unseparated therefrom. This provides certain advantages in concealing the weft edge, and more particularly, the braid, when the hair weft extension embodiment 50 of FIG. 6 is used along a part line or hairline. This process is illustrated in FIGS. 8 through 11, and explained in detail further below.

One problem with the extension hair strands 52 and attachment hair strands 64 being essentially coplanar is that they can be somewhat difficult to separate from one another when the finishing piece 50 is attached to the wearer's native hair. This adds to the time and effort required for the stylist or operator to tediously separate the extension hair strands 52 from the attachment hair strands 64 in order to braid or entwine the attachment hair strands 64 with the native hair of the wearer without tying up some of the extension hair strands 52 of the extension piece therewith. The extra time and attention required to separate the extension hair strands 52 and attachment hair strands 64 results in greater cost to the client and a less efficient operation.

Accordingly, a separation sheet 69 may be placed between the weft edge 58 and the attachment hair strands 64 at the time the attachment hair filament strands 64 are stitched or otherwise secured to the weft edge 58. The separation sheet 69 extends in the same direction from the weft edge 58 as do the extension hair strands 52 and attachment hair filament strands 64 and serves to separate the extension hair strands from the attachment hair strands, thereby greatly simplifying the task of braiding or entwining the attachment hair filaments 64 with the native hair of the wearer while excluding the extension hair strands 52 of the extension piece 50. The separation sheet 69 may be formed of any suitable material, e.g., a very thin, flexible, transparent sheet of plastic material (e.g., polyethylene, etc.), or even certain water resistant papers or lightweight woven materials, as desired. Preferably, the separation sheet 69 is formed of a waterproof, non-water soluble, or water resistant material in order to withstand moisture that may be used during the hair extension installation process.

The separation sheet 69 is formed of a relatively weak material in order to permit it to be torn from its attachment to the weft edge 58 when no longer needed. The separation sheet 69 need not be particularly strong or sturdy to perform its function of separating the extension hair and attachment hair strands 52 and 64; a relatively weak material is desired in order to allow it to be torn easily from its attachment along the weft edge 58. The separation sheet 69 may be relatively narrow in the direction of the extension hair strands 52 and attachment hair strands 64, as any separation is sufficient to allow the operator or stylist to pull the attachment hair strands 64 free of the extension hair strands 52 to perform the attachment procedure. Alternatively, the separation sheet 69 may have a width substantially equal to the lengths of the attachment hair filaments or strands 64, if so desired.

Another alternative to the above described weft construction would be to use some of the extension hair strands 52 to intertwine or braid with the native hair of the wearer. This would preclude need for a separate sheet, ply, row, etc. of attachment hair strands or filaments. However, this would have the effect of reducing the number and fullness of the otherwise visible extension hair strands 52, as a number of such strands 52 would be bound up in the attachment braids of the wearer's native hair. Accordingly, it is preferable to provide a separate ply, sheet, row, etc. of attachment hair fibers, filaments or strands 64 in addition to the ply or plies of extension hair strands 52.

Figure 7:
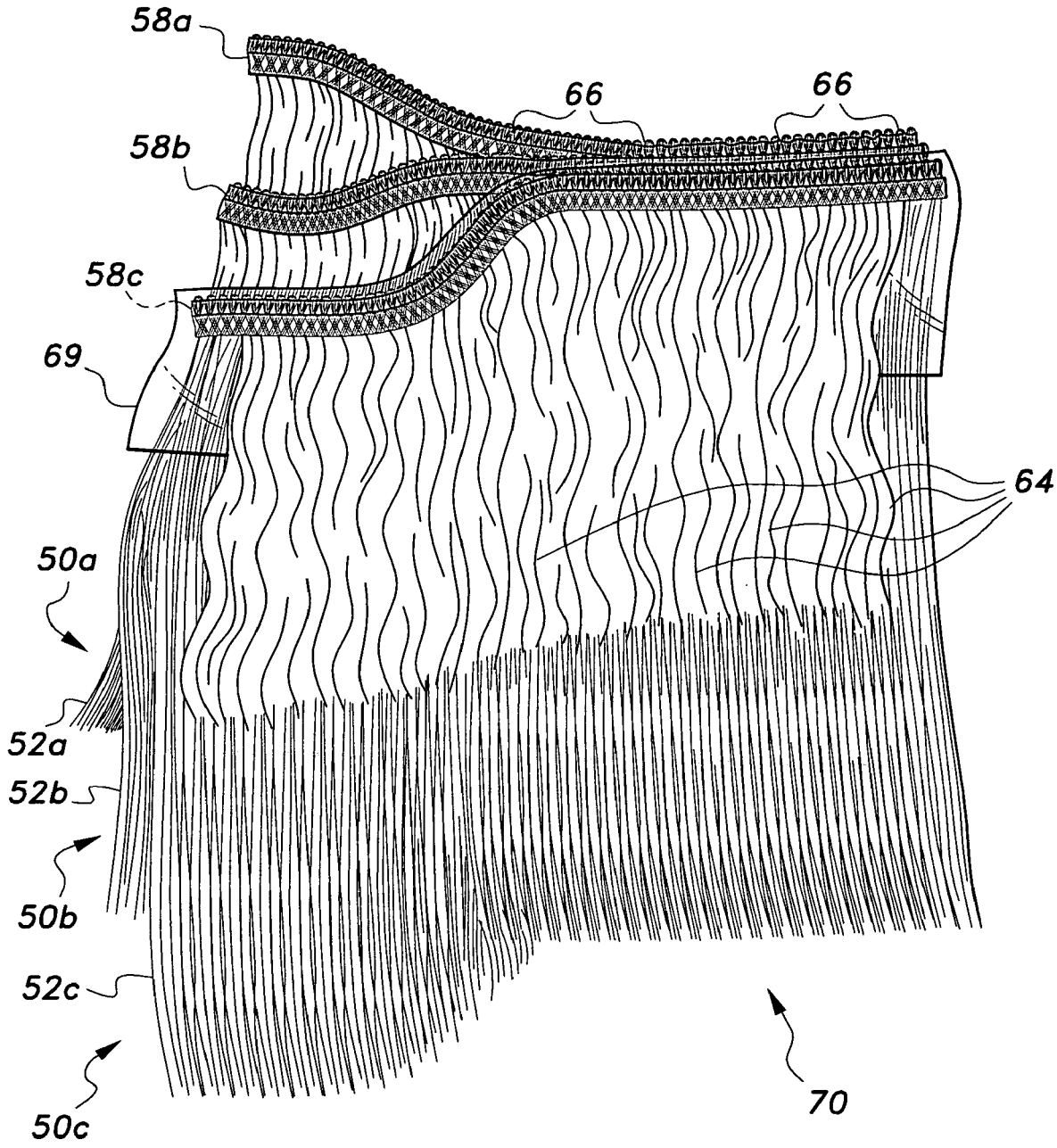
FIG. 7 is a rear elevation view of a partially constructed alternative embodiment of the finishing piece wefted hair extension of FIG. 6, illustrating the overlapping assembly of a plurality of hair wefts to form a fuller and denser hair extension.

FIG. 7 illustrates an alternative embodiment of the wefted hair extension 50 of FIG. 6 in which a plurality of such finishing hair extensions are sewn or otherwise permanently secured together along their wefted edges to form a multiple weft extension 70 having a fuller and more dense fall or extension of hair. In FIG. 7, a series of wefted extensions 50*a*, 50*b*, and 50*c*, each substantially identical to the extension 50 of FIG. 6, are assembled together to form the multiple weft extension 70 by sewing or stitching their respective wefts 58*a*, 58*b*, and 58*c* together along their entire lengths. (The multiple weft extension 70 illustrated in FIG. 7 is incomplete, with the final stitching of the wefts 58*a*, 58*b*, and 58*c* shown uncompleted at the second ends thereof, in order to show clearly the three distinct wefts employed in the manufacture of the multiple weft extension 70.) The wefts 58*a*, 58*b*, and 58*c* are secured together in an overlapping configuration, with the upper edge of the weft 58*b* secured slightly below the upper edge of the weft 58*a*, and the upper edge of the weft 58*c* secured slightly below the upper edge of the weft 58*b*.

The weft attachment ends 66 of the attachment hair strands 64 are preferably captured and secured at the point where the wefts 58*b* and 58*c* are sewn together with attachment hair filaments or strands 64 extending from the wefts 58*a* through 58*c* in the same direction as the extension hair strands 52*a*, 52*b*, and 52*c*, similarly to the configuration of the single weft finishing extension 50 of FIG. 6. As in the case of the single-ply weft 50 of FIG. 6, the multiple-ply weft assembly 70 of FIG. 7 may include a separation sheet 69 between the attachment hair strands 64 and the adjacent extension hair strands 52*c* to facilitate the separation of the attachment strands 64 during the installation of the extension 70.

Figure 8:
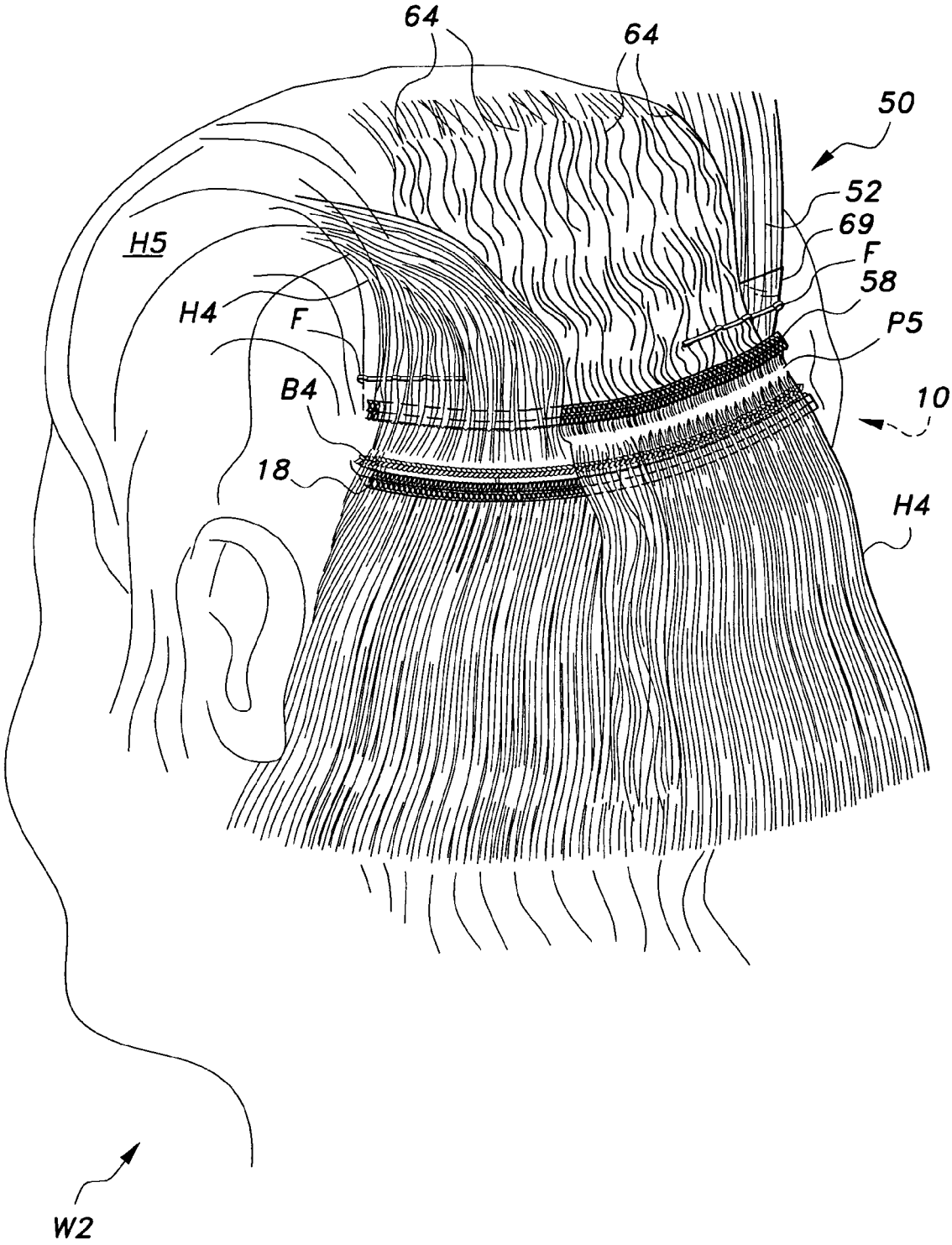
FIG. 8 is a rear perspective view of the head of a wearer of the present hair extension invention, showing a first step in the installation of a finishing piece hair extension to the native hair of the wearer.
Figure 9:
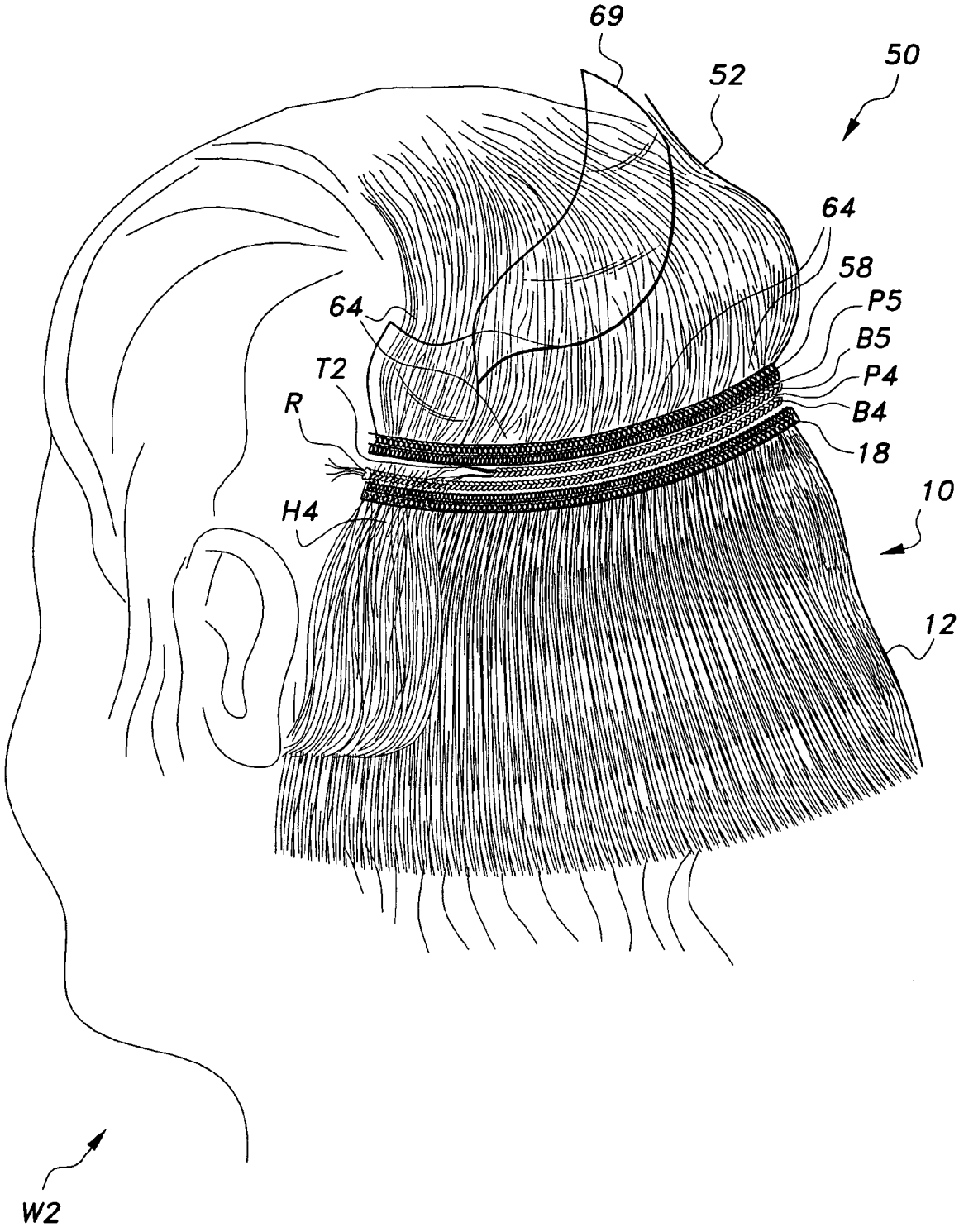
FIG. 9 is a rear perspective view of the wearer's head of FIG. 8, showing the second step in the installation of the finishing piece hair extension of the present invention.

The process by which the wefted hair finishing extensions are installed in the hair of a wearer is illustrated in FIGS. 8 through 11, and described in detail below. Initially, first and second part lines P4 and P5 are formed transversely across the head of a wearer W2 of the finishing hair extension 50, defining a transverse line or row of braidable native hair H4. (The lower part line P4 is concealed by the overlying and downwardly extending braidable hair row H4 in FIG. 8, but is shown in FIG. 9.) The extension hair 52 of the wefted hair finishing extension 50 is temporarily secured to the underlying, forwardly and upwardly combed hair H5 of the wearer W2 by means of bobby pins or other suitable fasteners F, as shown in FIG. 8. The extension hair 52 of the finishing piece 50, as well as the attachment hair strands or filaments 64, thus extend upwardly and forwardly over the native hair H5 of the wearer W2 in FIG. 8, with the part line P5 separating the weft edge 58 of the extension 50 from the row of braidable native hair H4 extending downwardly below the part line P5. The extension hair 52 and attachment hair strands 64 of the extension 50 are separated by the separator sheet 69, at least adjacent to the weft edge 58.

At this point, a braiding pattern is initiated in the row of hair H4 between the two part lines P4 and P5, generally as shown in FIG. 9 of the drawings. The wefted hair extension attachment hair strands or filaments 64, which have been pulled down and entrained in the braidable native hair H4, are braided integrally with the native hair H4 during this step in the process. In FIG. 9, the braiding process has been started from the first end of the hair extension 50, to the right side of FIG. 9, working from right to left across the head of the wearer W2 to form the beginning of a finishing piece braid row B5. The initiation of the braiding sequence from the right side is not required, and any braiding pattern may be used as desired, depending upon the orientation of the part lines formed in the hair of the wearer. It should be further noted that the formation of essentially horizontal hair extension attachment braid rows is not critical. The hair extension attachment braid rows may be formed either horizontally across the wearer's scalp, or in any other non-horizontal pattern as desired. The pattern may vary considerably, depending upon the pattern, length, fullness, and perhaps other factors of the native hair of the wearer, and those same factors of the hair extension attachment(s) being applied.

The braiding is accomplished by dividing the strands of native hair H4 between the two part lines P4 and P5 into three sections to form multiple fingers T2 of the wearer's native hair, and then braiding these fingers T2 together, along with the wefted extension attachment hair strands or filaments 64 as they are encountered with their entrainment in the braiding hair H4 of the wearer. A French or other type of braid may be used as desired, with the braiding lying immediately adjacent the scalp of the wearer. The separator sheet 69 is shown partially removed as the attachment strands are braided into the native hair of the wearer, working from the right side toward the left side in FIG. 9. The intentionally relatively weak structure of the separator sheet 69 allows it to be torn easily from its attachment to the weft base or edge 58 when it is no longer required.

It will be noted in FIG. 9 that since the attachment hair strands or filaments 64 of the finishing piece hair extension 50 extend in a generally upward direction in the same direction as the extension hair strands 52 extending therefrom, the braiding of these attachment filaments 64 into the fingers of native hair formed from the hair row H4 disposed below the weft edge 58 of the finishing piece 50 will draw the attachment strands 64 downward over and across the weft edge 58 as the braid B5 is formed. This is shown by the attachment hair strands 64 being tucked between the weft edge 58 and the completed portion of the braid B5 in FIG. 9. The tension on the attachment hair strands 64 will tend to pull or roll the weft edge 58 over to a certain extent, thereby lifting the attachment ends of the hair extension strands 52 away from the head of the wearer W2, as illustrated in FIG. 9.

Figure 10:
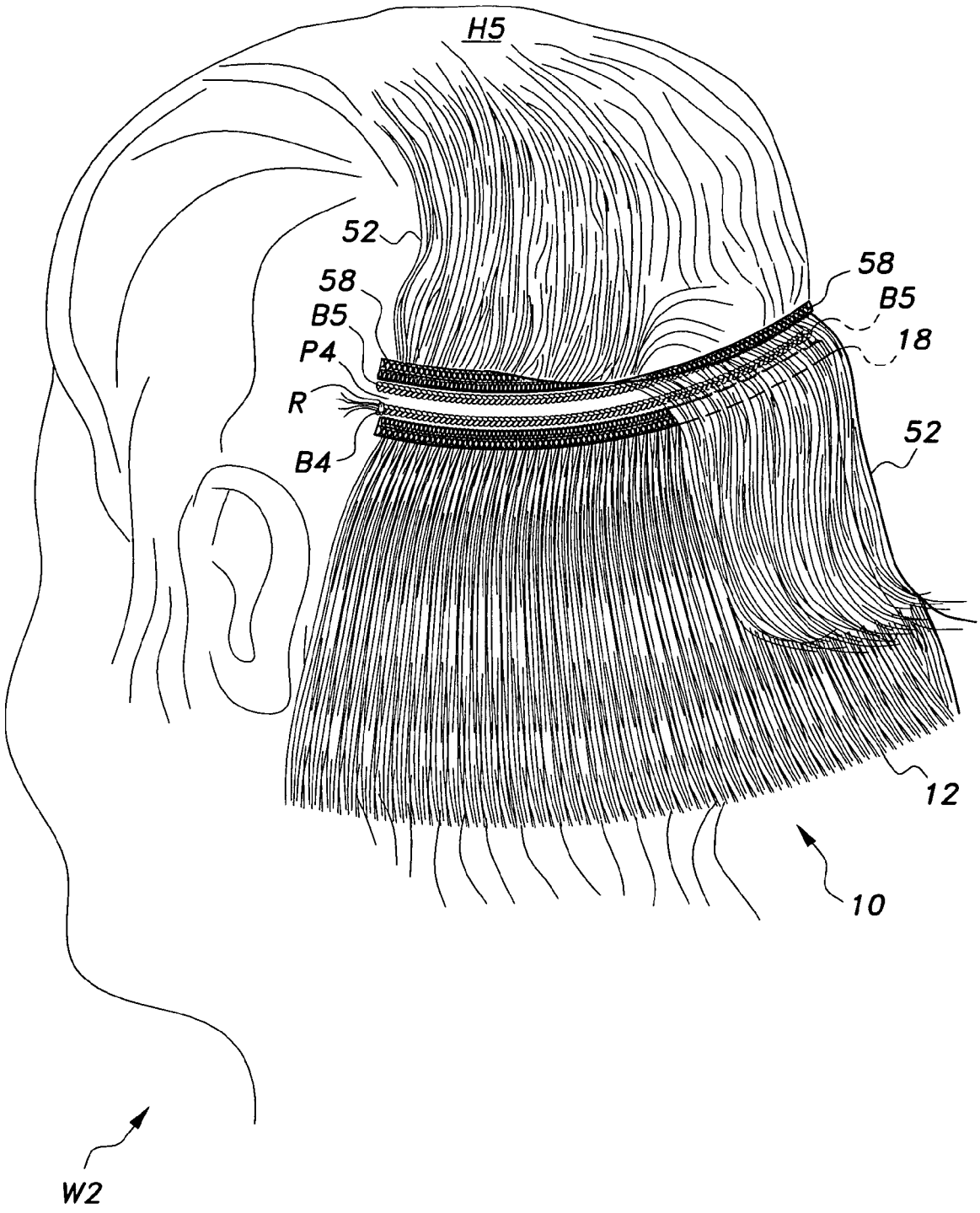
FIG. 10 is a rear perspective view of the wearer's head of FIGS. 8 and 9, showing the third step in the installation of the finishing piece hair extension of the present invention.

When the braid B5 (and others) has been completed, the otherwise free end is secured by some means, e.g., by wrapping tightly with a small rubber band R or the like, as shown in FIGS. 9 and 10 for the earlier completed braid B4 to which a base extension piece 10 has been secured. At this point, the newly secured weft edge 58 extends along and above the newly completed braid B5. However, it is desired that the hair weft extension strands 52 extend downward and rearward (in the illustrated example), and merely combing or brushing them over would result in the hair weft extension strands initially extending upwardly before folding back downwardly over the head of the wearer W2.

A much more natural disposition of the wefted hair strands 52 is achieved by rolling or folding the weft edge 58 of the finishing hair extension 50 over the top of the newly completed braid B5. This also has the advantage of concealing the braid B5 beneath the weft edge 58 of the finishing extension 50, as is the purpose of the finishing extension piece 50. This step is shown in its partially completed phase in FIG. 10 of the drawings, with the right side of the weft edge span 58 having been rolled or folded to lie flat over the top of the underlying braid B5, the corresponding hair weft portion extending naturally downward over the underlying wefted hair 12 of the previously installed base extension piece 10. The opposite, left portion of the weft edge span 58 is shown in essentially the same orientation as shown in the previous FIG. 9, to clearly show the difference in orientation of the two weft edge span 58 end portions and the process of rolling or folding the weft edge 58 over the top of the associated braid B5.

The process for the installation of the finishing pieces 50 (or multiple weft piece 70, as shown in FIG. 7) may be continued to form as many braided rows as desired, with a corresponding number of hair extension weft rows secured thereto by means of the attachment hair strands or filaments braided integrally therewith. The completed braid rows, and hair extension weft rows, may form a relatively wide sinusoidal pattern back and forth over the scalp of the wearer W1, or may alternatively be installed as a series of separate wefted hair extension pieces in separate rows, if so desired.

Figure 11:
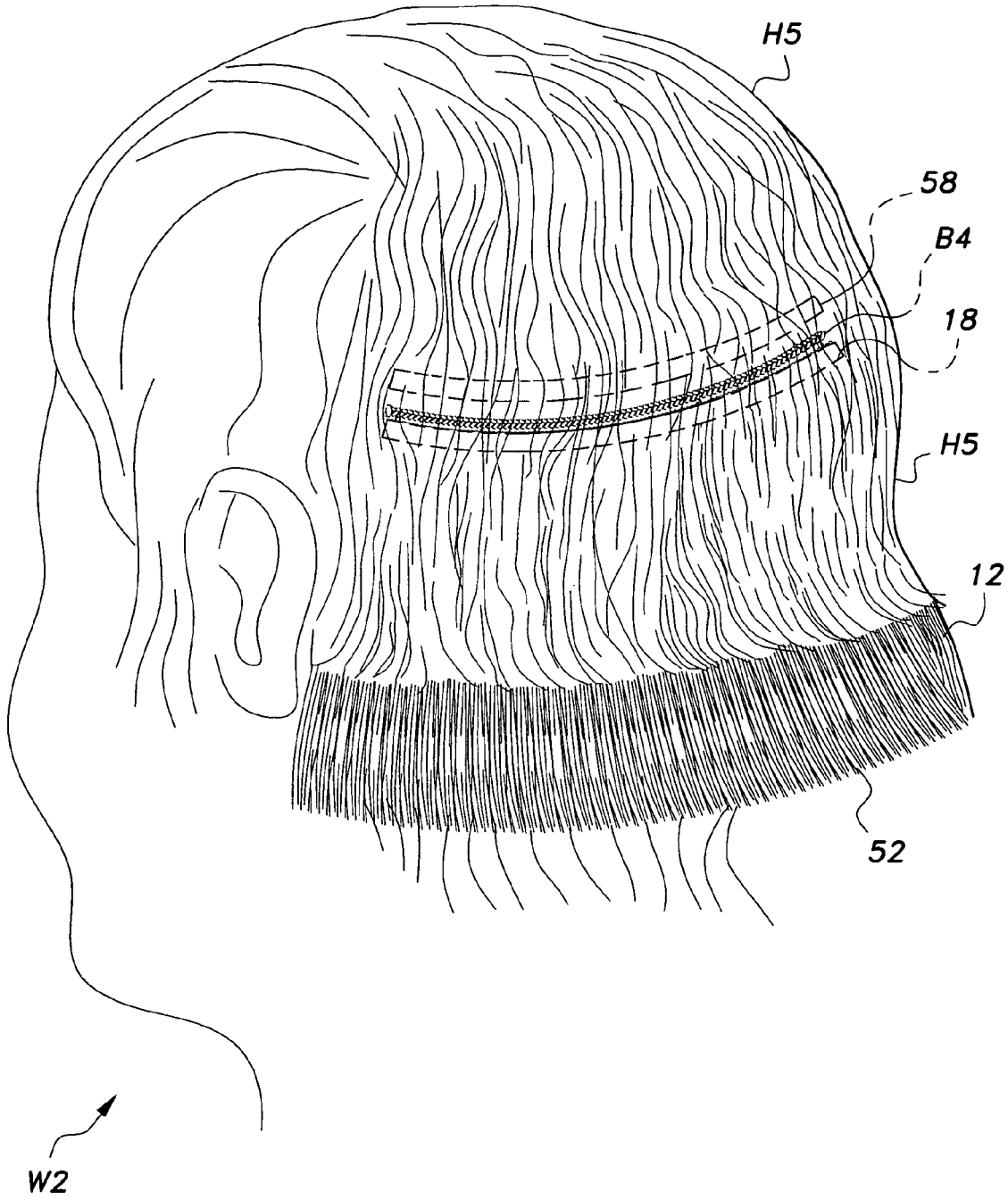
FIG. 11 is a rear perspective view of the wearer's head of FIGS. 8 through 10, showing the fourth step in the installation of the finishing piece hair extension of the present invention.

FIG. 11 depicts the end result of the above-described hair extensions and integral attachment strands and method of installation. In FIG. 11, the weft edge 58 of the finishing weft extension 50 has been completely folded over to completely conceal the underlying braid B5 (not shown in FIG. 11). The wefted hair 12 of the underlying base piece 10 installed immediately below the finishing piece 50 extends below its respective attachment braid B4. The weft edges 18 and 58 of the two hair extensions 10 and 50, as well as the attachment braid B4 for the base extension 10, are concealed by combing or brushing the native hair H5 of the wearer W2 over the weft edges and braids, generally as shown in FIG. 11.

Figure 12:
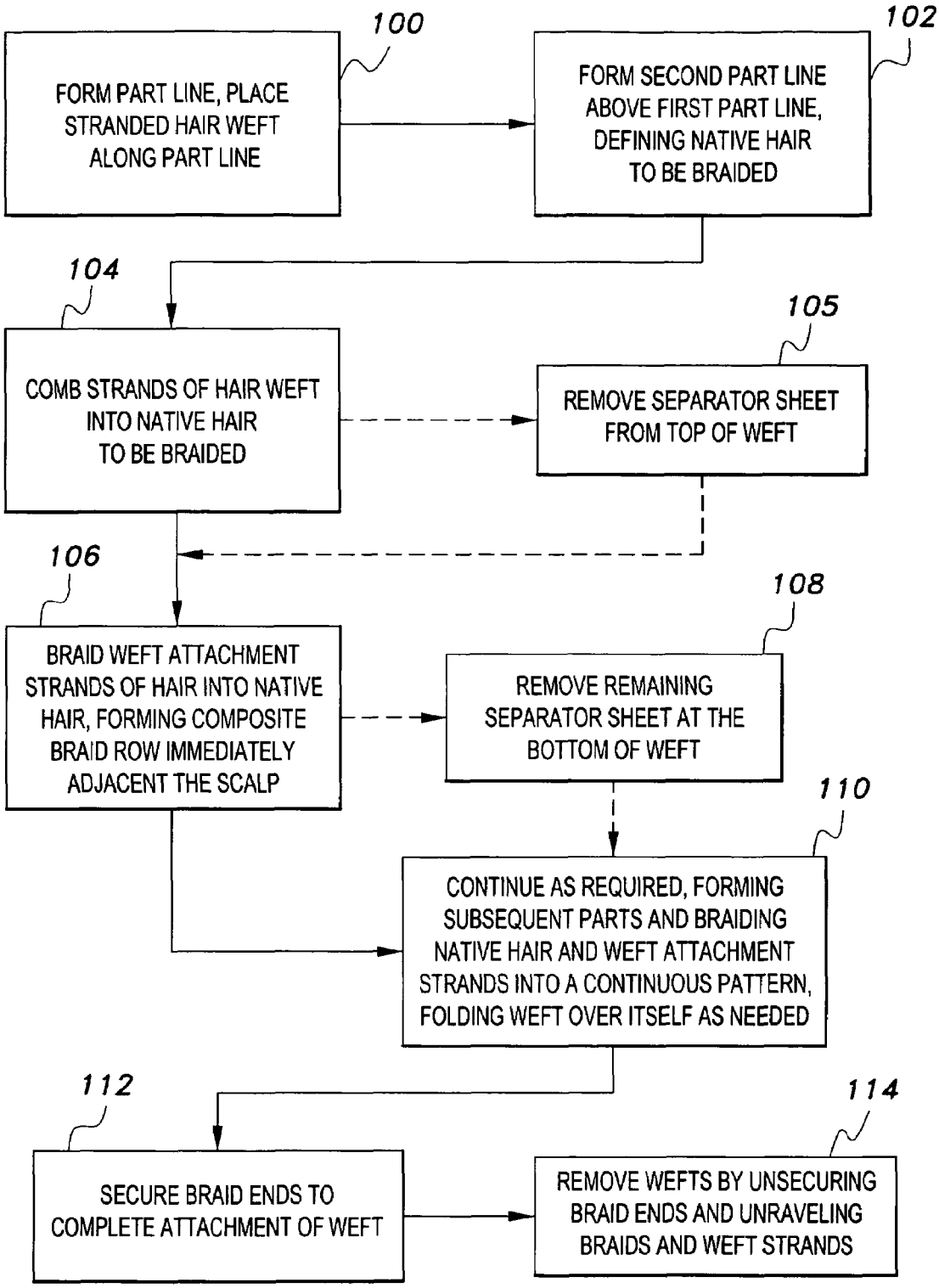
FIG. 12 is a flowchart briefly describing the basic steps in the method of installation and removal of the hair extension attachments of the present invention.

FIG. 12 provides a flowchart briefly summarizing the steps in the method of installation and removal of the wefted hair extensions and their attachment strands. All of the methods of installing the various embodiments of the wefted hair extensions begin by forming a part line along the location of the wearer's head where the hair extension is to be installed, and temporarily securing the hair extension to the native hair adjacent the part line, generally as indicated in the first step 100 of FIG. 12. After this has been accomplished, a second part line is formed slightly removed from the first part line, with the two generally parallel part lines defining a row of the wearer's native hair to be braided, generally as indicated in the second step 102 of FIG. 12.

At this point, the attachment hair strands or filaments extending from the weft edge of the hair extension piece are combed into the native hair to be braided, as indicated by the third step 104 of FIG. 12. This part of the operation is facilitated by the presence of the separator sheet (if provided) disposed between the wefted hair and the attachment strands, as shown in FIGS. 6 through 9 and described further above. As the continuous span of attachment filaments are progressively combed and braided into the wearer's native hair, the separator sheet may be removed progressively as desired, generally as indicated by the fourth step 105 of FIG. 12. This step is indicated as an optional step, as indicated by the broken lines connecting the fourth step with the others, depending upon whether the separator sheet was provided with the hair extension weft. The separator sheet normally has a relatively narrow portion extending to the opposite side of the seam from the hair strands and attachment strands in order to provide positive attachment. This narrow edge of the separator sheet is torn away immediately prior to the placement of the hair extension on the wearer's head to avoid entrapping this edge in the hair as the extension is braided into place. The perforations in the separator sheet due to its stitching to the weft assembly provide a weakening line, which allows the narrow edge of the separator strip to be torn away easily.

The native hair along the row between the part lines is progressively braided from one end to the other, with the hair weft attachment hair strands braided into the wearer's native hair during the braiding operation to produce a composite braid row comprising the wearer's native hair and the weft attachment hair strands, generally as indicated by the fifth step 106 of FIG. 12. After each braid is finished the remaining exposed separator sheet (if provided) is then removed, as indicated by the optional sixth step 108 of FIG. 12. This process is continued as desired, with subsequent parts being formed in the wearer's hair and braiding the native hair and weft attachment hair strands continuing until the desired result is achieved, generally as indicated in the seventh step 110 of FIG. 12. Alternatively, a series of separate braids and hair weft extensions may be installed to overlap one another, if so desired.

Once the braiding and weft strand attachment operation has been completed, the free end of the braid is secured to prevent unraveling, generally as indicated by the eighth step 112 of FIG. 12. The result is an attractive hairstyle of full-bodied hair which is very difficult to tell from the wearer's natural hair when the present attachment procedure is performed by a skilled practitioner. The hair extensions and integral attachment hair strands, and corresponding methods of attachment to the wearer's native hair, allow the extensions to be secured in place to the wearer's native hair simultaneously with the braiding operation, thus saving time otherwise required in a subsequent operation to attach the hair wefts after the native hair has been braided. The attachment of the wefts to the wearer's native hair is as secure as more time consuming sewing methods, and substantially more secure than adhesive or mechanical hair attachment methods. The hair extensions and attachment methods allow the supplemental wefted hair to be worn for up to several weeks at a time, with only normal care (shampooing, brushing, etc.) being required, just as in the case of the wearer's native hair. The wearer of the present hair extensions can swim, change hair styles, wash and otherwise care for their hair, and in general treat their supplemental hair extensions in the same manner as they would their native hair, yet the installation is quite cost effective, due to the labor savings involved.

When the wearer desires to remove or replace the wefted hair extensions of the present invention, it is only necessary to remove the small band or other component securing the distal end of the braid(s), and unravel the braid(s), generally as indicated by the ninth step 114 of FIG. 12. The attachment hair strands of the hair extensions will automatically separate from the braided strands or fingers of the wearer's native hair, as the braid(s) become(s) unraveled. This operation may be quickly and easily accomplished by the wearer of the hair extensions without need for additional professional care or assistance, as is required where hair extensions are sewn or otherwise mechanically or adhesively fastened to the wearer's native hair. Removal of the hair extensions requires only on the order of thirty minutes or so to accomplish, thus resulting in a relatively minor expenditure even if the wearer decides to have a professional remove the hair extensions.

FIGS. 13 through 16 illustrate additional embodiments of the present hair extension attachment wherein the weft base comprises a two-dimensional sheet of material, rather than a relatively narrow and thin weft edge. The two-dimensional sheet provides broader coverage and is more suitable as a crown piece or the like for covering areas of thinning hair, e.g., bald spots, or for persons (men or women) who may have hair loss due to chemotherapy or other treatments, etc.

Figure 13:
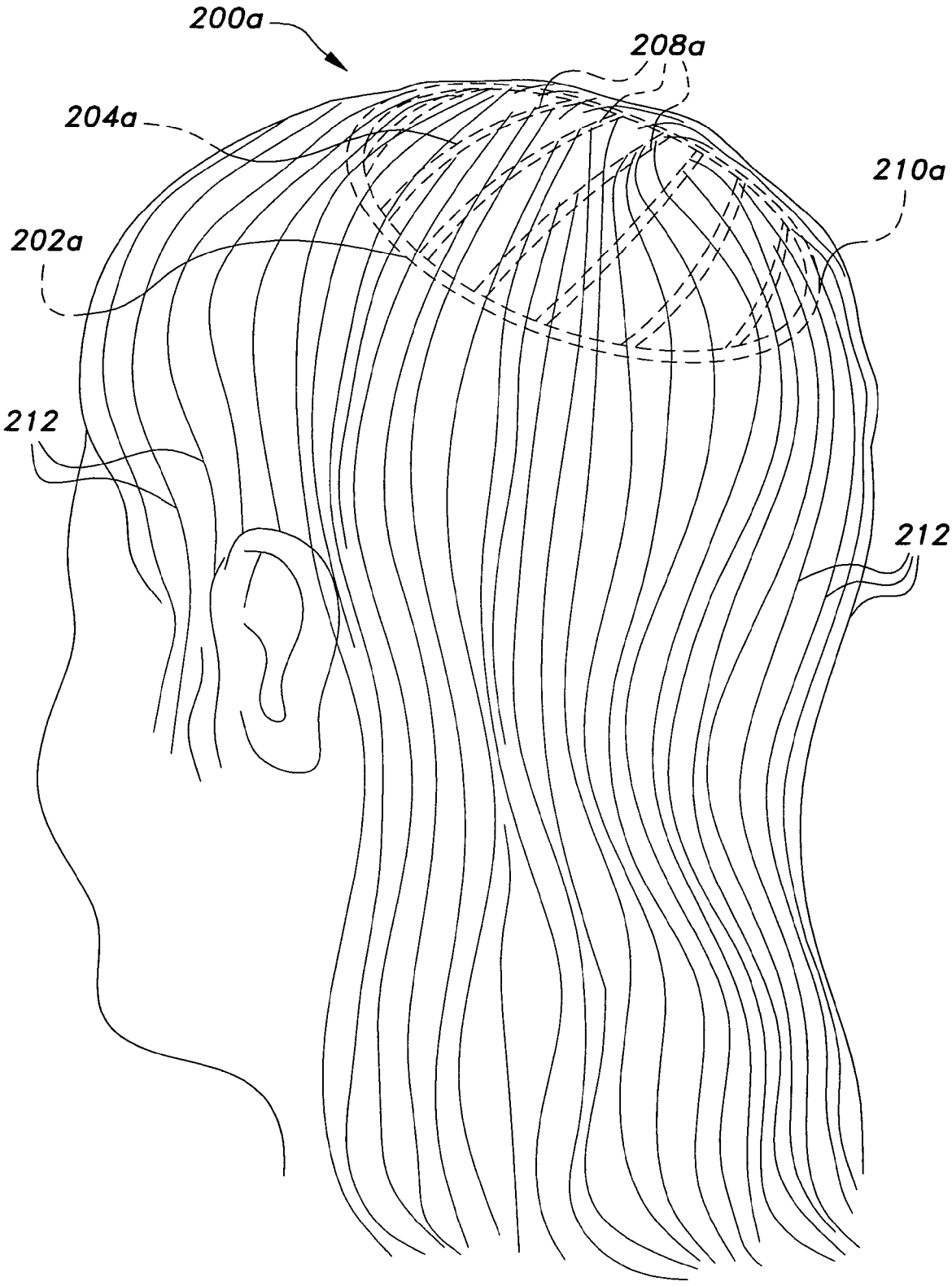
FIG. 13 is a rear perspective view of the head of a wearer of an alternative crown piece embodiment of a hair extension of the present invention having a two-dimensional base.

FIG. 13 provides a top perspective view of the upper or weft attachment surface of a first embodiment 200*a*. The device comprises a thin, flexible, two-dimensional weft base sheet of material 202*a*, having a weft surface 204*a* and an opposite attachment surface 206 (shown in FIG. 15). The weft base sheet 202*a* is preferably formed of a thin, flexible, open weave fabric material. Various lace-type materials have been found suitable in testing, particularly when assembled with a thin mesh sheet to form a composite. Such a structure precludes stretching of the base 202*a*, and provides sufficient strength. The base 202*a* may be provided in any color as desired, e.g., to closely match the flesh tones of the scalp of the wearer. While the device of FIGS. 13 through 15 is round or circular in plan view, it will be understood that this is exemplary, and the base may be formed in virtually any practicable shape or size as desired.

At least one hair weft is secured (e.g., by adhesives, stitching, etc.) to the upper or weft attachment surface 204*a* of the base sheet 202*a* to form a two-dimensional array (i.e., spanning the length and width of the base sheet), with the wefted hair extending from the hair weft(s). In the example of FIG. 13, a series of relatively short span hair wefts 208*a* are disposed laterally across the width of the generally circular weft base 202*a*, with a circumferential weft 210*a* extending about the periphery of the weft base 202*a*. Alternatively, the flexibility of such wefts would permit a single weft to be deployed back and forth over the weft surface 204*a* of the weft base sheet 202 in a sinusoidal pattern, or other pattern as desired. The wefts in turn each have a large plurality of hair strands 212 extending therefrom, in the manner of the finishing extension wefts 50 of FIGS. 6 through 11. The orientation of the wefts results in certain specific patterns for the extension hair, and the wefts may be arrayed as desired over the weft attachment surface of the weft base in any of the embodiments as desired. The hair 212 may be formed of strands of artificial or natural hair, as in the case of the embodiments of FIGS. 1 through 11. Additional tufts of hair (not shown, for clarity in the drawing Fig.) may be added between wefts for better concealment of the weft seams, if so desired.

Figure 14:
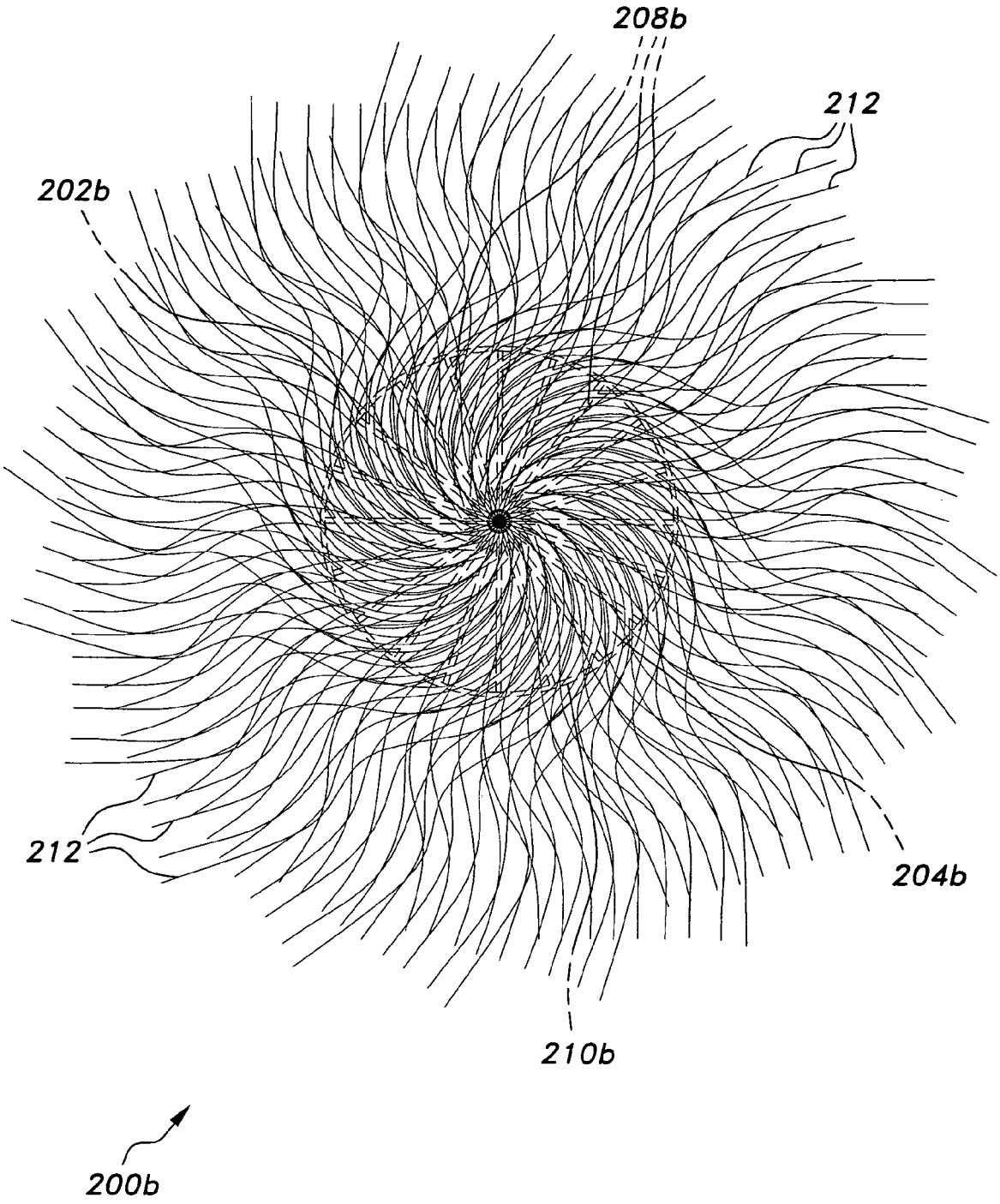
FIG. 14 is a top plan view of the two-dimensional crown piece embodiment of FIG. 13, showing the hair weft attachment pattern thereto.

FIG. 14 is a top plan view of a slightly different embodiment of the crown piece, designated as crown piece 200*b*. The crown piece 200*b* is essentially like the crown piece 200*a* of FIG. 13, comprising a thin, flexible, two-dimensional open weave fabric base sheet 202*b* having a weft or hair attachment surface 204*b* and an opposite attachment surface. A plurality of generally central hair wefts 208*b* are attached to the weft surface 204*b* of the device in a generally radial array, with a circumferential weft 210*b* extending about the periphery of the base sheet 202*b*. Each of the wefts 208*b* and 210*b* includes a large plurality of hair 212 extending therefrom. It will be noted that the radial arrangement of the centralized wefts 208*b* results in the hair extending from those wefts forming a pattern in which the hair from one weft always extends over the attachment of the adjacent weft, thus concealing all of the wefts. The hair from the centralized wefts 208*b* also extends outward sufficiently to conceal the attachment of the peripheral weft 210*b*. The result is a crown piece having a very natural appearance when installed. It should be noted that the attachment hair strands or filaments are not shown in FIG. 13 or 14, as these views depict the side or surface of the crown piece 200*a* or 200*b* having the externally disposed and displayed weft extension hair 212 extending therefrom.

Figure 15:
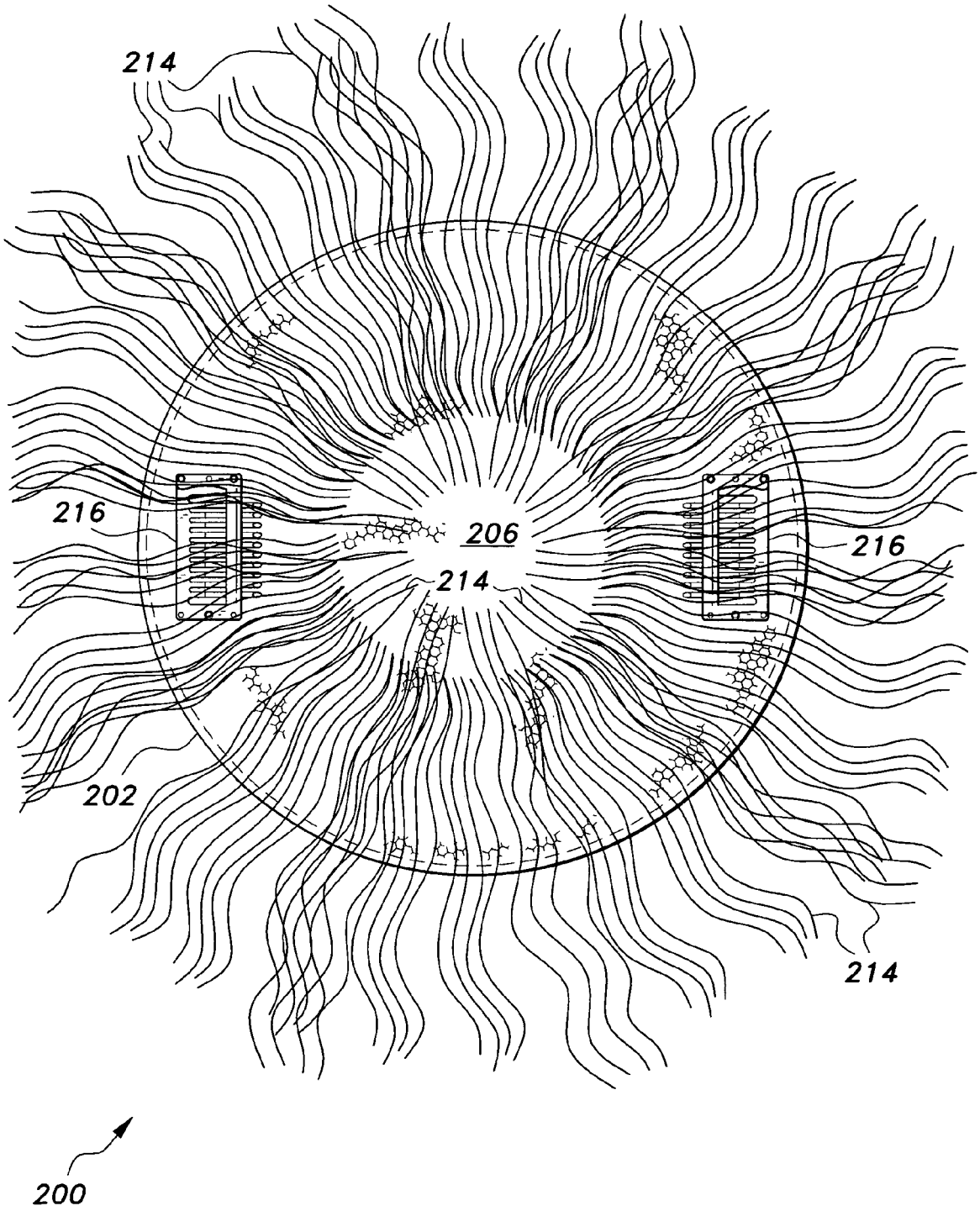
FIG. 15 is a bottom plan view of the two-dimensional crown piece of FIG. 14, showing the continuous pattern of attachment hair strands extending therefrom.

FIG. 15 provides a bottom plan view of a generic crown piece 200, showing the attachment of the flexible attachment hair strand filaments 214 to the attachment surface 206 of the device. (The displayed hair extension strands, which would extend outwardly from the opposite unshown side of the crown piece in FIG. 15, are not shown in FIG. 15, for clarity in the drawing.) As in the case of the attachment strands of the linear weft embodiments of FIGS. 1 through 11, the attachment strands 214 may be sewn or otherwise secured (adhesive, etc.) to the attachment surface 206 of the two-dimensional base sheet 202. The attachment hair strands or filaments 214 are used in the same manner as the attachment hair strands of the linear weft embodiment, interwoven with the wearer's native hair as it is braided in a series of rows to secure the device to the scalp of the wearer.

The attachment side or surface 206 of the device shown in FIG. 15 also reveals a pair of small combs 216 secured thereto. These combs 216 act as supplemental attachment devices, and assist in securing the periphery of the two-dimensional crown piece to the scalp to assure that the periphery does not lift to expose its edge or otherwise betray its installation. The combs 216 are not necessarily required, depending upon the number and location of the attachment strands, the nature and condition of the wearer's native hair, and perhaps other factors, but may be included as a supplemental attachment means, as desired.

Figure 16:
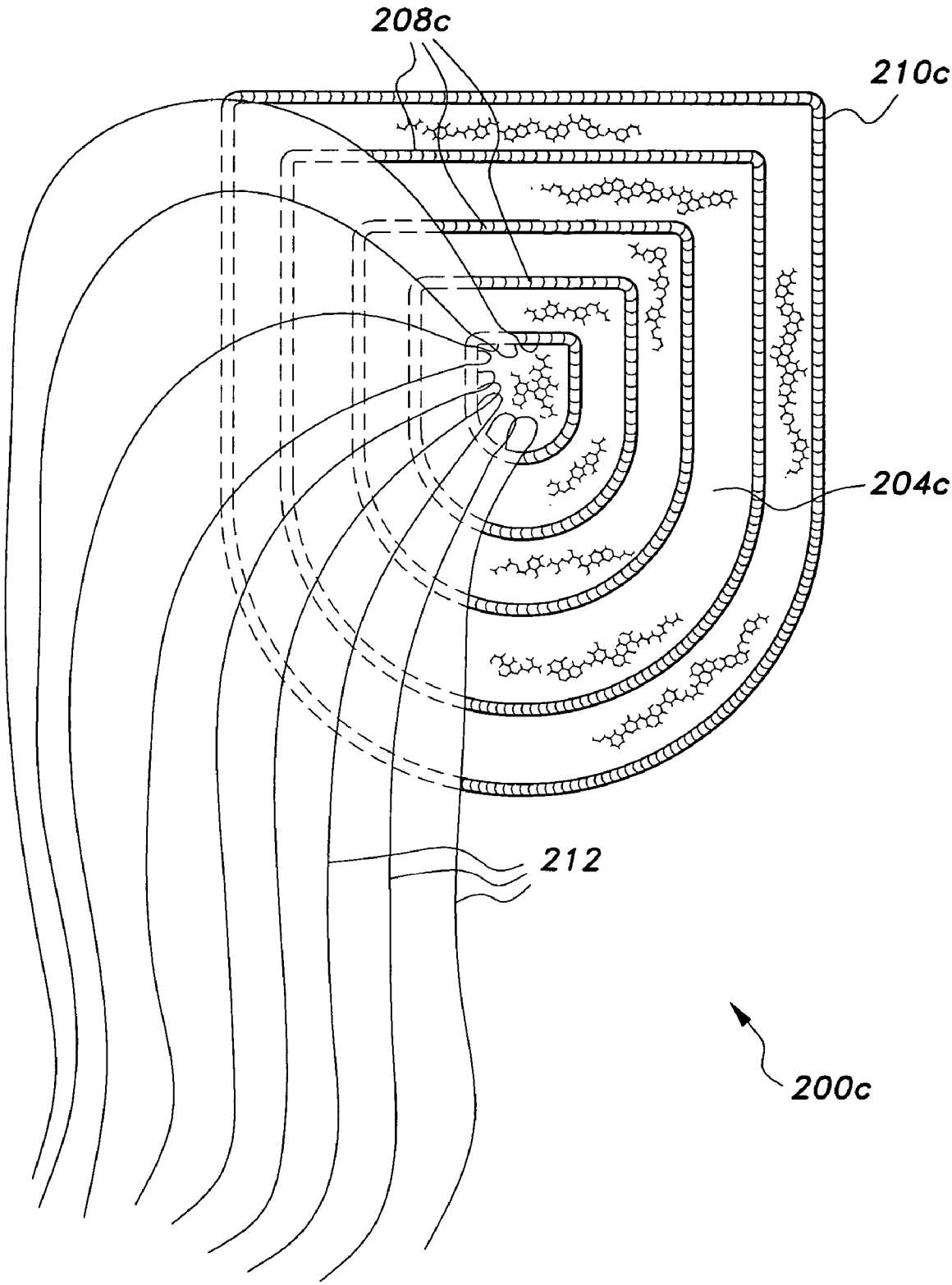
FIG. 16 is a top plan view of an alternative embodiment of the two-dimensional hair extension, with the hair shown partially removed in order to show the weft attachment pattern thereto.

FIG. 16 provides a top plan view of another embodiment of the crown piece attachment, designated as hair extension attachment 200*c*. The crown piece hair extension attachment 200*c* of FIG. 16 differs from those of FIGS. 13 through 15 only in configuration, i.e., its plan view and the layout or pattern of the hair wefts installed thereon. It will be seen that the crown piece attachment 200*c* has a truncated oval shape, with the upper portion (as oriented in the drawing) having a broadly curved shape forming opposed corners with the sides of the device, rather than forming a smooth oval shape, as does the bottom of the device. This shape or pattern is exemplary, and merely shows one of innumerable different shapes or patterns which may be used with the two-dimensional weft attachment embodiment. It will be noted that the wefts 208*c* form a generally concentric pattern, with the outermost weft 210*c* again being installed circumferentially about the periphery of the device. (The display or extension hair 212 is only partially shown in FIG. 16, in order to more clearly show the concentric circumferential array of wefts 208*c* and 210*c*.)

Accordingly, the hair extension attachments and attachment methods provide the wearer with considerably more freedom in the care and treatment of their natural hair and supplemental hair, as well as considerably more options for changing styles as desired. The economy provided by the hair extensions and attachment methods, as well as the security and longevity of installation, enable the wearer to visit a hair professional more regularly than might be the case with more time and labor intensive supplemental hair procedures, thus allowing the wearer the option of economizing through the time and labor saved, or enjoying greater freedom to change hairstyles more frequently if so desired. Whatever the desires of the wearer, the hair extension attachments will be greatly appreciated by anyone who has occasion to install supplemental hair extensions in their native hair, whatever the reason may be.

It is to be understood that the present invention is not limited to the embodiments described above, but encompasses any and all embodiments within the scope of the following claims.

I claim:

1. A hair-on-hair extension system, comprising:

a thin, linear, bound weft edge having a first end and an opposite second end with an extensive span between the first and second ends;

a plurality of extension hair strands depending substantially unidirectionally from the weft edge to form a generally planar sheath of hair secured along the span between the first and second ends; and a plurality of flexible attachment hair strands extending substantially unidirectionally from the weft edge in substantially the opposite direction as said plurality of extension hair strands to form a generally continuous layer of attachment hair strands secured along the span between the first and second ends in an unbroken array for braiding integrally into native hair of a wearer.

2. The hair extension attachment according to claim 1, wherein said plurality of extension hair strands and said plurality of attachment hair strands are adhesively secured to said weft edge.

3. A hair extension attachment, comprising:

a thin, linear, bound weft edge having a first end and an opposite second end with an extensive span between the first and second ends;

a plurality of extension hair strands extending substantially unidirectionally from the weft edge to form a generally planar sheath of hair secured along the span between the first and second ends;

a plurality of flexible attachment hair strands extending substantially unidirectionally from said weft edge in substantially the same direction as the plurality of hair strands to form a generally continuous layer of attachment hair strands secured along the span between the first and second ends in an unbroken array for integrally braiding into native hair of a wearer; and a separator sheet extending from said weft edge and disposed between said attachment hair strands and said extension hair strands.

4. The hair extension attachment according to claim 3, wherein said plurality of extension hair strands and said plurality of attachment hair strands are adhesively secured to said weft edge.

5. A hair extension attachment, comprising:

a thin, flexible, two-dimensional weft base sheet having a welt surface and an attachment surface opposite the weft surface;

a plurality of linear wefts disposed in a two-dimensional array upon the weft surface of the weft base sheet;

a plurality of extension hair strands extending from each of the linear wefts; and a plurality of flexible attachment hair strands extending from the attachment surface of the weft base sheet to form a generally continuous span of attachment hair strands secured to the attachment surface of the weft base sheet in an unbroken array for integrally braiding into native hair of a wearer.

6. The hair extension attachment according to claim 5, further including a separator sheet disposed between said plurality of hair strands and said plurality of attachment strands.

7. The hair extension attachment according to claim 5, wherein said plurality of wefts are disposed on said sheet in a radial array and a circumferential weft is disposed about a periphery of said sheet.

8. The hair extension attachment according to claim 5, wherein said plurality of wefts are disposed in a concentric circumferential array.

9. The hair extension attachment according to claim 5, wherein said weft base comprises an open weave fabric sheet.

10. The hair extension attachment according to claim 5, further including at least one attachment comb disposed upon the attachment surface of said weft base.

11. The hair extension attachment according to claim 5, wherein said plurality of hair strands and said plurality of attachment strands are adhesively secured to said weft base.

* * * * *